US006692882B2

(12) United States Patent
Oshiba et al.

(10) Patent No.: US 6,692,882 B2
(45) Date of Patent: Feb. 17, 2004

(54) IMAGE FORMING METHOD

(75) Inventors: Takeo Oshiba, Hachioji (JP); Fumitaka Mochizuki, Hachioji (JP); Kazuhisa Shida, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/006,816

(22) Filed: Dec. 5, 2001

(65) Prior Publication Data

US 2002/0110748 A1 Aug. 15, 2002

(30) Foreign Application Priority Data

Dec. 11, 2000 (JP) ..... 2000-375816

(51) Int. Cl.[7] ..... G03G 21/00
(52) U.S. Cl. ..... 430/125; 399/350
(58) Field of Search ..... 430/125; 399/350

(56) References Cited

U.S. PATENT DOCUMENTS 6,374,074 B1 * 4/2002 Oono ..... 399/350

* cited by examiner

*Primary Examiner*—Mark A. Chapman
(74) *Attorney, Agent, or Firm*—Muserlian, Lucas and Mercanti

(57) ABSTRACT

A method of forming a toner image is disclosed. The photoreceptor is installed so that the center axis of the cylinder is to be almost horizontal, front edge of the cleaning blade is pressed against surface of the photoreceptor at the top, ratio of width of the photosensitive layer of the photoreceptor to length of the cylindrical electroconductive substrate is 80/100 to 99/100, and a number ratio of toner particles having a shape coefficient of 1.2 to 1.6 is at least 65 percent in the toner particles.

11 Claims, 8 Drawing Sheets

FIG. 9 ( a )
TONER HAVING NO CORNERS
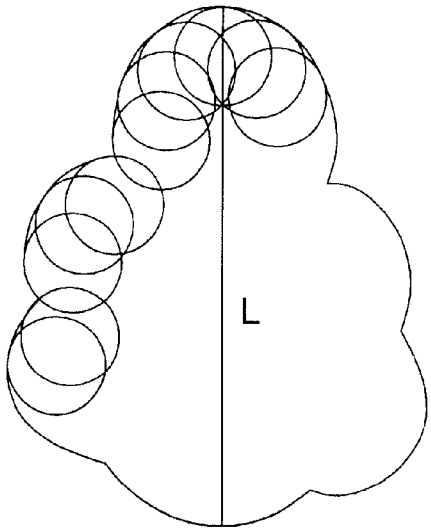
FIG. 9 ( b )
TONER HAVING CORNERS
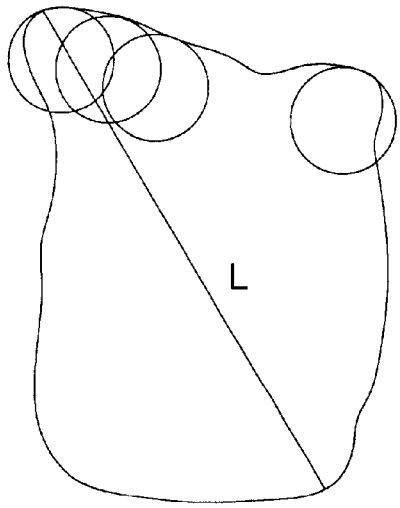
FIG. 9 ( c )
TONER HAVING CORNERS
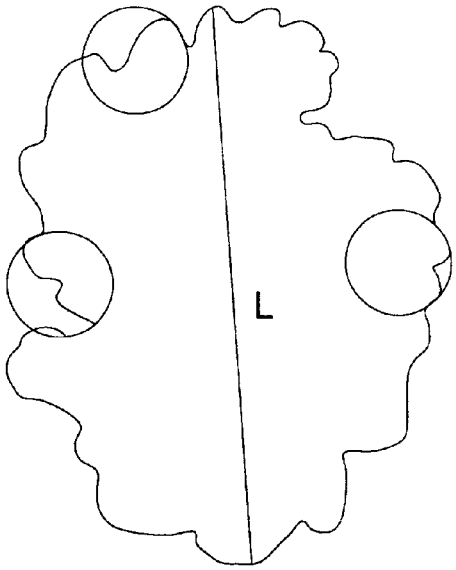

IMAGE FORMING METHOD

FIELD OF THE INVENTION

This invention relates to an image forming method and an image forming apparatus applicable to a copying machine or a printer each according to an electrophotographic method.

BACKGROUND OF THE INVENTION

Recently an organic photoreceptor containing an organic photoconductive substance is widely used in an image forming apparatus according to an electrophotographic method. On the organic photoreceptor, various problems tend to be occurred on cleaning of the toner remained after transferring the toner to the image receiving material since the contact energy of the organic photoreceptor to the toner developing the latent image formed on the organic photoreceptor is large.

An electrophotographic image forming apparatus having a cleaning device just above a cylindrical electrophotographic photoreceptor has been proposed in Japanese Patent Application No. 11-290755. Such the image forming apparatus has an advantage that the apparatus can be made compact. When a blade scrapes the toner at the flank of the cylindrical photoreceptor, the toner is freely falls by the gravitation. However, when the cleaning blade is contacted just above to the photoreceptor, incompleteness of cleaning is often occurred since the toner scraped off by the cleaning blade tends to be remained on the surface of the photoreceptor.

Recently, a digital image forming method has been become as main stream of the image forming method accompanied with the progress of the digital technology. In the digital image forming method, a small dot image such as a image of 400 dpi is developed. Accordingly a high quality image forming technology is required by which such the small dot image can be reproduced with high fidelity.

One of the most important technologies for raising the image quality relates to the production of the toner. Currently, a toner produced by mixing, kneading, powdering and classifying a binder resin and a pigment has been mainly used for forming the electrophotographic image. However, the toner produced by such the process is insufficient in the particle size distribution and the shape uniformity. It is difficult to form an image with a sufficient quality by the use of such the toner.

A electrophotographic developer or an image forming method using a polymerized toner is proposed as the means for achieving the satisfactory particle size distribution and the uniform shape uniformity. The polymerized toner has the satisfactory particle size distribution and the shape uniformity since the toner is produced by polymerizing monomer uniformly dispersed in an aqueous medium.

A problem is newly raised when such the polymerized toner is used in an image forming apparatus having the organic photoreceptor. Namely, the cleaning tends to be incomplete since the shape of the toner particle is almost sphere and has a high attractive force to the organic photoreceptor surface.

Particularly, when the polymerized toner is applied to the image forming apparatus in which the cleaning device is arranged just above the cylindrical organic photoreceptor, very fine toner particles, by which no visible transferred image is formed, are slipped and passed through the cleaning blade and a charging device such as a charging wire or a charging roller is contaminated by such the very fine toner particles for a long period. As a result of the contamination, unevenness in the halftone image is formed.

SUMMARY OF THE INVENTION

The object of the invention is to solve the above-mentioned problem and to provide an image forming method and an image forming apparatus by which incomplete cleaning occurred in the image forming apparatus having a cleaning blade arranged just above the cylindrical organic photoreceptor, hereinafter referred to as a cylindrical photoreceptor, an organic photoreceptor or a photoreceptor, is prevented so that the cleaning property is maintained for a long period and a sufficient electrophotographic image without any image defect can be obtained even when the polymerized toner is used.

As a result of the investigation by the inventors, it is made possible that a good cleaning ability is maintained and a satisfactory electrophotographic image is obtained for a long period by using a toner particles having a specific shape factor and reducing the exposed area of the substrate of the organic photoreceptor even though the image forming apparatus having a cleaning blade arranged just above the cylindrical organic photoreceptor. The object of the invention can be achieved by the followings.

1. A method of forming a toner image, comprising:
   - electrically charging a photoreceptor comprising an organic photosensitive layer provided on a cylindrical substrate;
   - imagewise exposing the photoreceptor so that a latent image is formed on the photoreceptor;
   - developing the latent image with toner so that a toner image is formed on the photoreceptor;
   - transferring the toner image to a recording material from the photoreceptor; and
   - cleaning residual toner on the photoreceptor by cleaning blade; wherein
     - the photoreceptor is installed so that the center axis of the cylinder is to be almost horizontal,
     - front edge of the cleaning blade is pressed against surface of the photoreceptor so that cylindrical center angle $\beta$ of the cylindrical photoreceptor is at an angle of within $\pm 30°$ with respect to 0° of the vertical line passing the center axis of the cylindrical photoreceptor,
     - ratio of width of the photosensitive layer of the photoreceptor to length of the cylindrical electroconductive substrate is 80/100 to 99/100, and
     - a number ratio of toner particles having a shape coefficient of 1.2 to 1.6 is at least 65 percent in the toner particles.
2. A method of forming a toner image, comprising:
   - electrically charging a photoreceptor comprising an organic photosensitive layer provided on a cylindrical substrate;
   - imagewise exposing the photoreceptor so that a latent image is formed on the photoreceptor;
   - developing the latent image with toner so that a toner image is formed on the photoreceptor;
   - transferring the toner image to a recording material from the photoreceptor; and
   - cleaning residual toner on the photoreceptor by cleaning blade; wherein
     - the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and number ratio of toner particles having no corners is 50 percent or more with reference to whole toner particles.

3. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

4. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner has a number variation coefficient of the number distribution of the toner particle of not more than 27%.

5. A method of forming a toner image of claim 4, wherein the toner has a number variation coefficient of the number distribution of the toner particle of not more than 25%.

6. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner has a number variation coefficient of the shape coefficient of the toner particle of not more than 16%.

7. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner contains toner particles having a shape coefficient of from 1.2 to 1.6 in a ratio of not less than 65% in number and a variation coefficient of the shape coefficient of not more than 16%.

8. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner contains toner particles having a variation coefficient of the shape coefficient of not more than 16% and a variation coefficient of the particle number in the particle size distribution of not more than 27%.

9. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner particles are prepared by association of particles obtained by polymerization of monomers in a water based medium.

10. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and contacting width of the cleaning blade is wider than width of the photosensitive layer of the organic photoreceptor.

11. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the photoreceptor comprises a protective layer containing a compound containing a fluorine or silicone atom.

BRIEF DESCRIPTION OF THE DRAWING

FIG. 9(*a*) is an explanatory view showing a projection image of toner particle having no corners.

FIGS. 9(*b*) and 9(*c*) are explanatory views showing projection images of toner particles having corners.

DETAILED DESCRIPTION OF THE INVENTION

Figure 1:
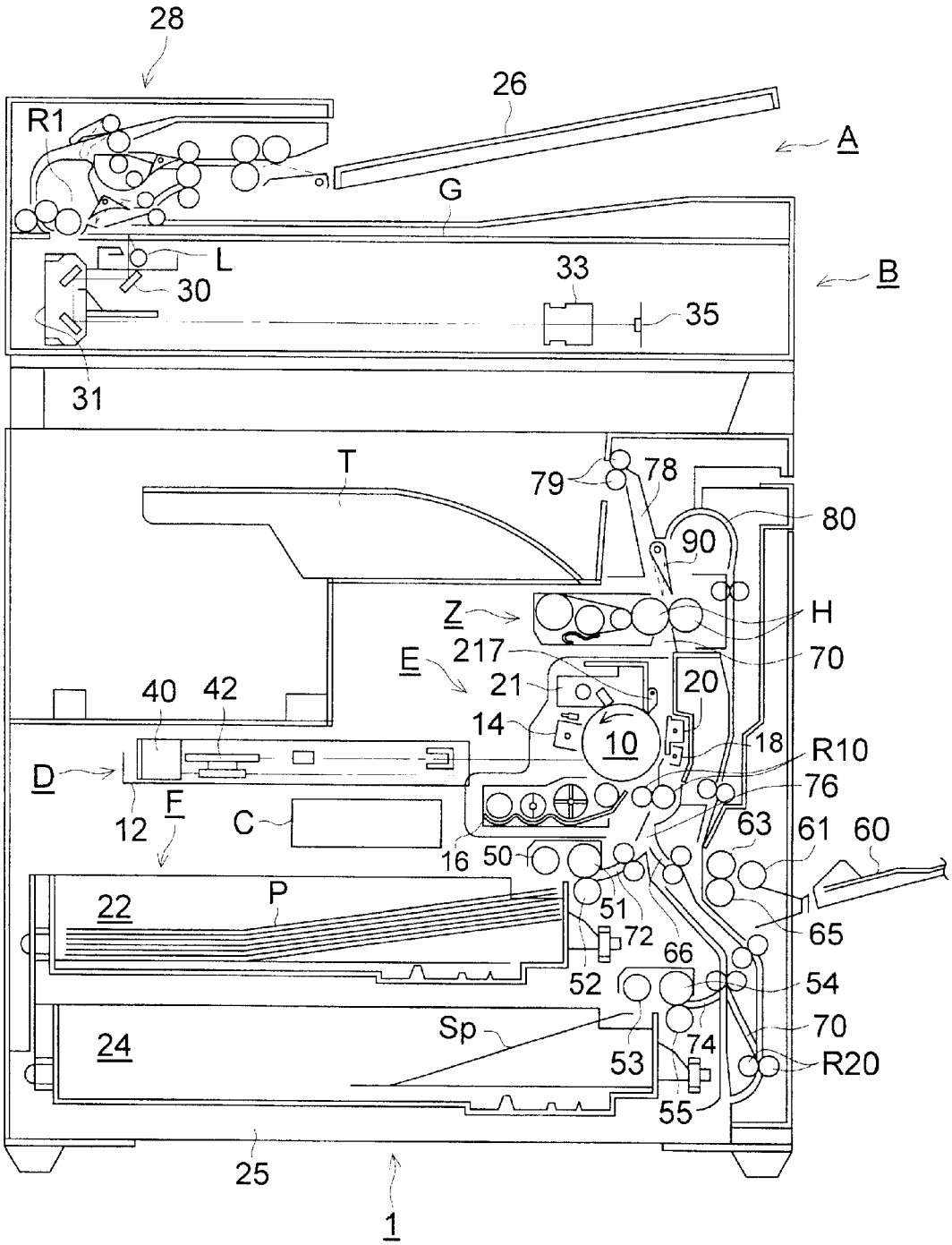
FIG. 1 is a view showing a digital image forming apparatus according to the invention.

FIG. 1 shows a drawing of a digital image forming apparatus applicable to the invention, hereinafter simply referred to as an image forming apparatus.

The image forming apparatus 1 in the drawing has an automatic original feeding device A, usually called as ADF, an original image reading portion B for reading the image on the original fed by the automatic original feeding device, an image processing card C for processing the read original image, a writing portion D including a writing unit 12 for writing the image on a cylindrical photoreceptor 10 as an image carrier, an image forming portion E including image forming means such as the cylindrical photoreceptor 10 and a charging electrode 14, a developing means having a magnetic brush developing device 16, a transferring electrode 18, a separating electrode 20 and a cleaning means 21 each arranged around the cylindrical photoreceptor, and a storing portion F having paper supplying trays 22 and 24 each for storing recording paper sheets S.

One of original sheets placed on the original placing table 26, not shown in the drawing, is fed by an original feeding means 28 and exposed to light by an exposing means L while passing under the roller 1.

The reflected light from the original is focused on the CCD 35 by the mirror units 30 and 31 at the fixed position and the lens 33, and read.

The image information read in the image reading portion B is processed by the image processing means to be converted to cords and stored in a memory provided on the image processing card C.

The image data are called out and the laser light source 40 in the writing portion D is driven according to the image data and the cylindrical photoreceptor 10 is exposed to the light. In advance of the exposure, a prescribed surface potential is applied by corona discharge from the charging electrode 14 to the cylindrical photoreceptor 10 rotating anticlockwise as is shown by the arrow in the drawing. The surface potential at the exposed area is reduced by the light exposure and a static latent image is formed on the cylindrical photoreceptor 10 according to the image data.

The static latent image is subjected to a reversal development by the developing means 16 to form a visible image.

The automatic original feeding device A has an original placing table 26, a group of roller including roller R1 and an original feed controlling means 28 having a passageway changing device, with no referring sign, for optionally changing the feeding passageway of the original.

The original image reading portion B is arranged under a platen glass plate G and constituted by two mirror units 30 and 31 each reciprocally movable maintaining the light passing length, a fixed imaging lens 33, hereinafter simply referred to as a lens, and a linear image pick-up element 35, hereinafter referred to as CCD. The writing portion D has a laser light source 40 and a polygon mirror 42, as a light modulation device.

R10 positioned in front of the transferring electrode 18 with respect to the moving direction of the recording paper S is a register roller and the device H positioned at the down stream side of the separating electrode 20 is a fixing means.

The fixing means H usually comprises a roller in which a heating source is built and a rotatable pressure roller contacted to the heating roller.

Z is a cleaning means of the cleaning means H and the significant component of which is a cleaning web provided so as to be capable of being wound up.

Besides, one of the recording papers S is arrived at the register roller 10 and the position of the front edge of the paper is adjusted before the arrival of the front end of the toner image on the cylindrical photoreceptor at the transferring portion.

The recording paper S is transported to the image transferring portion by the roller 10 which is rotated synchronously so that the paper is agreed with the image area on the cylindrical photoreceptor 10.

In the image transferring area, the toner image on the cylindrical photoreceptor 10 is transferred on the recording paper by the transferring electrode 18, and then the recording paper is separated from the cylindrical photoreceptor 10 by the separating electrode 20.

The toner image is fixed by fusing on the recording paper by pressuring and heating by the fixing means H, and the recording paper is delivered to an outlet tray T through an outlet course 78 and an outlet roller 79.

The referring sign Sp in the paper supplying tray 24 is a movable plate which is constantly pressed by a pressing means such as a coil spring, not shown in the drawing, so that the free end of the plate is pressed in the upper direction. Accordingly, the most upper sheet of paper is touched to the feeding roller.

The paper supplying tray 22 has a structure similar to the above-mentioned.

In the embodiment, the paper supplying trays 22 and 24 are arranged in two steps in the direction of top and bottom, but more trays may be arranged.

A space 25 having a prescribed space is provided between the paper supplying trays 24 arranged at the lowest position and the bottom floor of the image forming apparatus.

The space 25 is used in a mode for forming images on both sides of the recording paper, and contributes to reverse the recording paper accompanied with the second conveying passageway 80 for reversing the recording paper.

The rollers 50 and 53 arranged above the front end of each of the paper supplying trays, corresponding to the front end of the stored paper in the feeding direction, are paper supplying rollers. Rollers 51 and 54 are feeding rollers and 52 and 55 are double feed preventing rollers.

The supplying rollers 50 and 53 and the feeding rollers 51 and 54 are each unitized respectively in a unit so that each the unit easily can be attached to or detached from a fastening means or a driving shaft connecting to the driving source provided on the apparatus.

The double feed preventing rollers 52 and 55 are also unitized so that the unit can be easily attached to and detached from a fixing portion provided in the apparatus.

The component 60 is a tray for paper supplying by hand which can be opened and shut to the side wall of the image forming apparatus 1 on the fulcrum at the lower end of the tray.

The roller 61 is a feeding roller for feeding a sheet of recording paper placed on the hand paper supplying tray 60 accompanied with the image formation, 63 is a feeding roller arranged at the lower stream of the feeding roller 61, 65 is a double feed preventing roller to prevent feeding of two or more sheets of the recording paper at the same time which is contacted by pressure to the feeding roller 63. The tray and the roller are constituted substantially the same as the foregoing paper supplying trays 22 and 24.

In the drawing, 60 shows a conveying passageway of recording paper supplied from the hand supplying tray 60, which is joined to the later-mentioned junction point through a pair of rollers arranged at just left side of the feeding roller 63.

Sign 70 shows the first conveying passageway which extends in the direction of from lower to upper with respect to the moving direction of the recording paper supplied from the optional paper supplying tray.

Sign 72 shows a conveying passageway of the recording paper stored in the paper supplying 22 positioned at the upper stage, and 76 is a junction point of the passageways, a part of the first conveying passageway, at which the sheets of the recording paper each supplied from the tray 22 and 24, respectively.

Sign 80 shows is an outlet passageway for discharging the recording paper on which an image is formed to an outlet tray T.

Sign 80 shows the second conveying passageway for reversing the recording paper when images are formed on the both sides of the recording paper, which is joined to the first conveying passageway at the upper portion of the drawing.

The second conveying passage 80 extends in the direction of from upper to lower with respect to the moving direction of the recording paper.

The lower portion of the second conveying passageway 80 extends lower than the paper supplying position of the lower paper supplying tray 24 and joined to the first conveying passageway 70.

The first conveying passageway 70 and the second conveying passageway 80 form a vertically extended loop at a wall side of the apparatus.

A conveying means R20 constituted by a pair of reversibly rotating rollers, which is also used as switchback rollers, is arranged at the junction point of the first conveying passageway 70 and the second conveying passageway 80.

The junction point also can be seen as a diverging point since the recording paper is not continuously conveyed from the second passageway 80 to the first conveying passageway 70.

A passageway joining with the space 25 is provided under the switchback roller R20, which is used to direct the recording paper moved through the second conveying passageway 80 to the space 25 for reversing the recording paper.

In the image forming process, the latter end of the recording paper is held by the switchback roller R20 when the recording paper moved through the second conveying passageway 80 is conveyed to the space 25. Accordingly, a part of the recording paper is stayed in the space 25.

Sign 90 shows an upper diverging guide which is controlled so as to lead the recording paper to the paper discharging passageway 78 or to the second conveying passageway 80.

Thus the passageway of the recording paper can be changed according to the mode optionally set by the user, the mode of image forming on one side or both sides of the recording paper.

When an image is formed at the image forming portion E, the cylindrical photoreceptor 10 is rotated and charged by discharge from the charging electrode 14. Then a static latent image is written in the writing portion D. The static latent image is developed by the developing means 16 to form a toner image. The toner image is transferred by the transferring electrode 18 onto recording paper supplied from the paper supplying tray 22 or 24, or the hand supplying tray 60. The recording paper is separated by the separating electrode 20 and subjected to the fixing treatment by the fixing means H, and discharged onto the outlet tray T.

The toner remained on the cylindrical photoreceptor after the transfer of the toner image is removed by the cleaning means 21.

Figure 2:
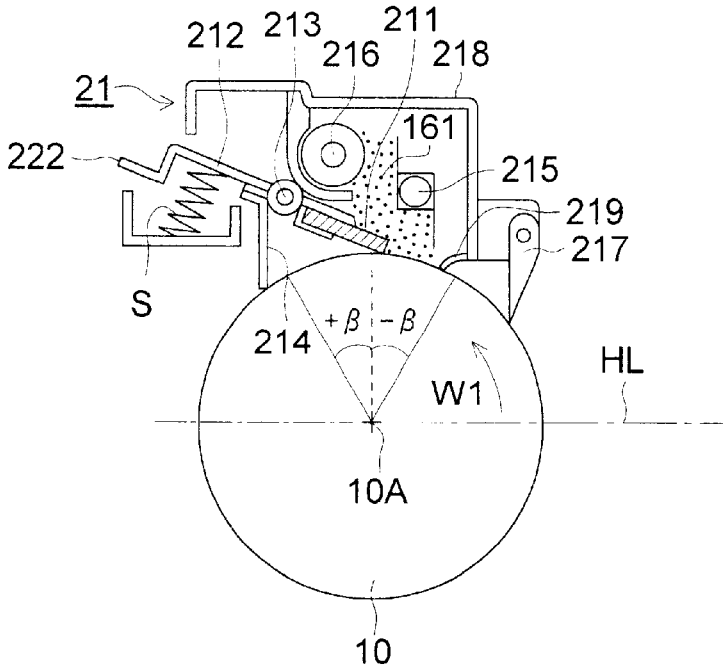
FIG. 2 is a sectional view of the cleaning device employed in the invention.

FIG. 2 shows a cross-section of the cleaning means usable in the image forming apparatus according to the invention.

In FIG. 2, the cylindrical photoreceptor 10 is installed in the image forming apparatus so that the center axis of the cylinder is to be almost horizontal. "Almost horizontal" means that the center axis of the cylindrical photoreceptor is at an angle of not more than 10° with the horizontal face. A cleaning means 21 is provided above the cylindrical photoreceptor 10. As is shown in the drawing, a cleaning blade 211 is positioned at a position higher than the line HT passing the rotating center 10A of the cylindrical photoreceptor 10. For cleaning the toner on the photoreceptor, the front edge of the cleaning blade 211 is pressed against the surface of the photoreceptor so that the cylindrical center angle β of the cylindrical photoreceptor is at an angle of within ±30° with respect to 0° of the vertical line passing the center axis of the cylindrical photoreceptor 10.

At a side of the framework 218 of the cleaning means 21 and at an upper stream of the cleaning blade, a sheet-shaped electroconductive member 219 and a separating claw 217 are provided which are touched to the surface of the cylindrical photoreceptor 10.

Moreover, in the framework 218, a rotatable supporting member 212 is supported by an axis 213 and the basal part of the cleaning blade 221 is fixed at an end of the supporting member 212. The supporting member 212 is provided so that another end thereof is exposed out of the framework 218.

In the cleaning means 21 in the working status, the front edge of the cleaning blade 211 is pressed against the cylindrical photoreceptor 10 by the elastic force of a spring S provided at the other end of the supporting member 212. An elastic plate 214 is provided on the supporting member 212 at the rear side of the cleaning blade 211 so that the elastic plate 214 is positioned at the lower stream than the axis 213 with respect to the rotation direction of the cylindrical photoreceptor 10. The elastic plate 214 prevents toner scattering when the pressure to the cleaning blade is released. The elastic plate 214 is preferably made of a plate of polyurethane rubber or poly(ethylene terephthalate).

Toner discharging members 215 and 216 are provided for successively discharge the remained toner from the framework 218 when the toner remained on the cylindrical photoreceptor 10 is removed by the cleaning blade 211 after transfer of the image.

Figure 3:
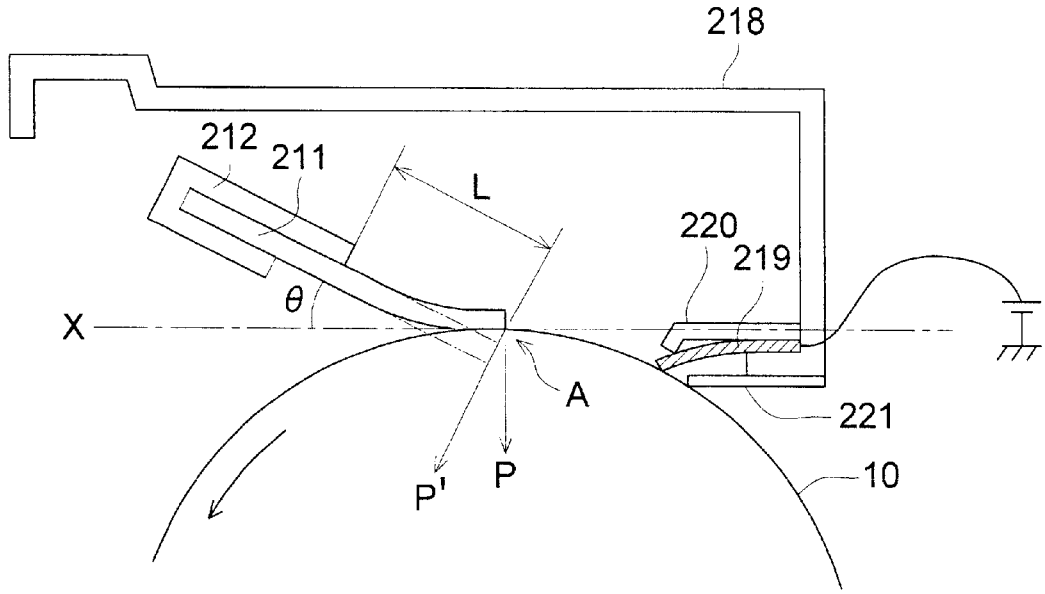
FIG. 3 is a detail view showing relationship of cleaning device to photoreceptor more in detail.

FIG. 3 describes in detail the cleaning blade, the sheet-shaped electroconductive member and the cylindrical photoreceptor.

In FIG. 3, the front edge of the cleaning blade 211 is contacted to the surface the photoreceptor at a point, contact point A, being within the range of ±30° with respect to the angle of the vertical line upward the center axis of the cylindrical photoreceptor of 0°.

In the invention, the pressing weight of the cleaning blade 211 against the photoreceptor P and the contact angle θ of the blade are each preferably P=5 to 40 N/m and θ=5 to 35°.

The free length L of the cleaning blade is a length from the end of the supporting member 212 to the front end of the blade before the deformation as shown in FIG. 3. The free length of the blade is preferably L=5 to 15 mm. The thickness of the cleaning blade is preferably from 0.5 mm to 4 mm.

The contacting weight P is a vector value in the normal line direction of the pressing weight P' to the cleaning blade 211 contacting with the cylindrical photoreceptor 10.

The contacting angle θ is an angle of the blade before deformation as shown in the drawing by double-dot broken line with the tangent line X at the contacting point A on the photoreceptor.

Elastic rubber is used for the cleaning blade. Examples of the usable elastic rubber include urethane rubber, silicone rubber, fluorinated rubber, chloroprene rubber and butadiene rubber. Among them urethane rubber is specifically preferable since it is superior to the others in the wearing resistively. For example, urethane rubber described in Japanese Patent Publication Open to Public Inspection No. 59-30574 is preferred which is produced by reacting and hardening polycaprolactone ester and polyisocyanate.

The sheet-shaped electroconductive member 219 is provided at a side of the framework 218 of the cleaning means 21 and the down stream side of the cleaning blade with respect to the rotation direction of the photoreceptor, and the front edge of the sheet-shaped electroconductive member 219 is touched to the surface of the photoreceptor. The charge on the toner and the photoreceptor is removed by such the construction. Consequently, the cleaning property is improved, excessive load is not applied to the cleaning blade and problems regarding the blade such as turn-off of the blade and noise generation by the blade are prevented.

In FIG. 3, 220 is a backing member of the sheet-shaped electroconductive member such as a creased poly(ethylene terephthalate) sheet, 221 is a toner guide such as a poly (ethylene terephthalate) sheet which prevents scattering the toner removed by the cleaning blade to exterior of the cleaning device. The sheet-shaped electroconductive member 219 is preferably grounded for effectively remove the charge on the toner or the photoreceptor.

The contacting width of the cleaning blade, width in the direction parallel to the axis of the cylindrical photoreceptor, is preferably wider than that of the photosensitive layer of the organic photoreceptor to prevent toner passing at the both sides of the cylindrical photoreceptor and occurring the incomplete cleaning.

An elastic rubber blade is preferably used as the cleaning blade in the invention, and the torque variation and the turning-off of the blade can be inhibited by controlling the rubber harness and the repulsion elasticity thereof with together. A JIS hardness of the blade at 25±5° C. of from 65 to 80 is preferable since the turning-off of the blade is difficultly occurred and satisfactory cleaning ability can be obtained. A repulsion elasticity of from 20 to 80 is preferable since the turning-off of the blade is difficultly occurred and satisfactory cleaning ability can be obtained. A repulsion elasticity of from 20 to 80 is more preferable. Young's modulus of the blade is preferably from 294 to 588 $N/cm^2$. The JIS hardness and the repulsion elasticity are measured by the physical test method for vulcanized rubber according to JIS K6301. The value of the repulsion elasticity is expressed by percentage.

In an image forming method using the above-mentioned cleaning means, incomplete cleaning tends to be occurred since the toner removed by the cleaning blade is difficultly released from the surface of the photoreceptor. Particularly, the incomplete cleaning is easily occurred when such the cleaning means is utilized in an image forming apparatus using a polymerized toner and an organic photoreceptor.

The ratio of the width of the photosensitive layer of the photoreceptor to the length of the cylindrical electroconductive substrate is preferably 80/100 to 99/100.

The width of the photosensitive layer of the cylindrical organic photoreceptor and the length of the cylindrical electroconductive substrate are each the width and the length in the direction of the axis of the cylindrical electroconductive substrate. When the width of the photosensitive layer is smaller than 80/100, cleaning of the toner by the cleaning blade is become insufficient and the toner tends to be pass through the cleaning blade. Under such the condition, the toner is easily passed at the both ends of the electroconductive substrate since the exposed area of the electroconductive substrate at the both ends thereof is made larger and the toner is easily passed at this area. Besides, when the width of the photosensitive layer is become larger than 99/100, the side edge of the photosensitive layer tends to be peeled by abrasion by the cleaning blade. Once the edge of the photosensitive layer is peeled, the peeled area is easily extended to the image forming area and turning-off of the blade and the passing of the toner tend to be occurred.

When the surface of the photosensitive layer comprises a material containing a fluorine atom or a silicon atom having a low surface energy, the adhesion force between the photoreceptor and the toner is made small. Therefore, cleaning of the toner can be sufficiently carried out and incomplete cleaning is difficultly occurred without applying an excessive load to the cleaning blade.

On the other hand, the toner remained on the organic photoreceptor can be effectively removed without increasing the abrasion force generated between the organic photoreceptor and the cleaning blade when a toner having a small adhering force is used.

In the invention, toners having the following properties can be used as the toner having a small adhering force with the photosensitive layer.

(1) A toner which contains toner particles having a shape coefficient of from 1.2 to 1.6 in a number ratio of not less than 65%.

When the shape coefficient is smaller than 1.2, the shape of the toner is neared true sphere and the adhering force of the toner to the photoreceptor is increased. Accordingly, the cleaning tends to be incomplete. On the other hand, when the shape coefficient is larger than 1.6, the toner particles are easily crushed to fine powdered particles which cause the incomplete cleaning. The toner containing particles each having a shape coefficient of from 1.2 to 1.6 in a ratio of not less than 65%, preferably not less than 70%, shows a suitable cleaning ability and contains toner particles which is difficultly powdered. Satisfactory cleaning ability and suitable image formation for a long period can be obtained when such the toner is applied to the cleaning means according to the invention.

(2) A toner containing toner particles having no sharp corner in a ratio of not less than 50% in number.

The "toner particle having no sharp corner" is a toner particle substantially having no projected portion at which the charge is concentrated or the particle is easily crushed by stress. When the toner contains such the toner particle having no sharp corner in a ratio of not less than 50% in number, more preferably not less than 70% in number, the fine particles by the stress caused by a developer conveying member are difficultly formed. Consequently, the incomplete cleaning caused by the formation of the fine toner particles can be prevented and the high cleaning ability and suitable image formation can be maintained for a long period. Accordingly, it is necessary that the number ratio of the toner particles having no sharp corner is not less than 50%, more preferably not less than 70%.

(3) A toner in which the sum of the relative frequency $m_1$ of the toner particles included in the highest frequent class and the relative frequency $m_2$ of the toner particles included in the next frequent class is not less than 70% in a histogram showing the number frequency of the particle size, in which the natural logarithm lnD of the particle diameter D in $\mu$m of the toner particle is graduated on the abscissa and the abscissa is classified to plural classes at a interval of 0.23.

When the sum of the relative frequency $m_1$ and the relative frequency $m_2$ is not less than 70%, the particle size frequency of the toner particles is become sharp and the toner image can be formed stably. Consequently, satisfactory cleaning ability and suitable image formation can be maintained for a long period when such the toner is applied to the cleaning means according to the invention.

(4) A toner having a number variation coefficient of the number distribution of the toner particle of not more than 27%.

When the toner has a number variation coefficient of the number distribution of the toner particle of not more than 27%, the particle size frequency of the toner particles is become sharp and the toner image can be formed stably. Consequently, satisfactory cleaning ability and suitable image formation can be maintained for a long period when such the toner is applied to the cleaning means according to the invention.

(5) A toner having a variation coefficient of the shape coefficient of the toner particles of not more than 16%.

When the toner has a number variation coefficient of the shape coefficient of the toner particle of not more than 16%, more preferably not more than 14%, the particle size frequency of the toner particles is become sharp and the toner image can be formed stably. Consequently, satisfactory cleaning ability and suitable image formation can be maintained for a long period when such the toner is applied to the cleaning means according to the invention.

In the invention, a toner is preferably used which contains toner particles having a shape coefficient of from 1.2 to 1.6 in a ratio of not less than 65% in number and a variation coefficient of the shape coefficient of not more than 16%. Such the toner has a small adhering force and a high cleaning ability.

In the invention, a toner is preferably used which contains toner particles having a variation coefficient of the shape coefficient of not more than 16% and a variation coefficient of the particle number in the particle size distribution of not more than 27%. Such the toner is superior in the cleaning ability and the fine line reproducibility, and a high quality image can be formed for a long period by the use of such the toner.

A toner which is superior in the cleaning ability and the fine line reproducibility can be obtained by controlling the ratio of the toner particle having no sharp corner to not less than 50% in number and the number variation coefficient of the particle size distribution to not more than 27%. A high quality image can be formed for a long period by the use of such the toner.

The particle size of the toner according to the invention is preferably from 3 to 8 $\mu$m in number average particle diameter. The diameter can be controlled by the concentration of coagulating agent, the adding amount of organic solvent, melt-adhering time or the composition of the polymer when the toner particle is produced by the polymerization method.

When the number average particle diameter is from 3 to 8 $\mu$m, existence of toner particle having an excessive adhesiveness to the developer conveying member or the toner particle having a low adhering force in the fixing process can be reduced. Then the developing ability can be stabilized for a long period, and the quality of a dot image, fine line and dot are improved since the transferring efficiency of the toner is raised.

The photoreceptor and the toner according to the invention are described in detail below.

The organic photoreceptor according to the invention is described below.

The organic electrophotographic photoreceptor, or the organic photoreceptor, is an electrophotographic photoreceptor in which at least one of the essential functions, the charge generation function and the charge transferring function, of the electrophotographic photoreceptor is performed by an organic compound. Namely, the organic electrophotographic photoreceptor includes a photoreceptor containing an organic charge generation substance or an organic charge transfer substance and that containing a polymer complex having the charge generation ability and the charge transfer ability.

The organic photoreceptor usable in the invention is described below.

Electroconductive Substrate

The cylindrical organic photoreceptor according to the invention is an organic photoreceptor using a cylindrical electroconductive substrate necessary for endlessly forming an image by rotation. The roundness and the bias of the cylindrical electroconductive substrate are each preferably not more than 0.1 mm, respectively. When the roundness and the bias exceed those ranges, a satisfactory image is difficultly formed.

A drum of metal such as aluminum and nickel, a drum of plastic evaporated with aluminum, tin oxide or indium oxide and a paper or plastic drum coated with an electroconductive substance can be used as the electroconductive material of the substrate. The conductivity of the electroconductive substrate is preferably not more than $10^3$ Ω cm in specific conductance at an ordinary temperature.

Aluminum having the surface which is anodized and sealed may be used as the electroconductive substrate. The anodizing treatment is usually performed in an acidic bath such as chromic acid, sulfuric acid, oxalic acid, phosphoric acid, boric acid and sulfamic acid. Among them, anodizing treatment in sulfuric acid gives the most preferable result. In the case of the anodization in sulfuric acid, a sulfuric acid concentration of from 100 to 200 g/L, an aluminum ion concentration of from 1 to 10 g/L, a liquid temperature of about 20° C. and an applying voltage of about 20 V are preferable. Average thickness of the anodized coat is usually preferably not more than 20 $\mu$m, particularly 10 $\mu$m or less.

Interlayer

In the present invention, it is possible to provide an interlayer having a barrier function between the electrically conductive substrate and the photosensitive layer.

In the present invention, in order to improve adhesion between the electrically conductive substrate and said photosensitive layer, or to minimize charge injection from said substrate, it is possible to provide an interlayer, including a sublayer, between said substrate and said photosensitive layer. Listed as materials of said substrate are polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 0.5 $\mu$m.

Further, listed as an interlayer, which is most preferably employed, is that comprised of hardenable metal resins which are subjected to thermal hardening employing organic metal compounds such as silane coupling agents, titanium coupling agents, and the like. The thickness of the interlayer comprised of said hardenable metal resins is preferably between 0.1 and 2 μm.

Photosensitive Layer

The photosensitive layer configuration of the photoreceptor of the present invention may be one comprised of a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration in which the functions are separated, it is possible to control an increase in residual potential, accompanied under repeated use at a low level, and to readily control the other electrophotographic properties to desired values. A negatively charged photoreceptor is preferably composed in such a manner that applied onto the interlayer is the charge generating layer (CGL), onto which the charge transport layer is applied. On the other hand, a positively charge photoreceptor is composed so that the order of the layers employed in the negatively charged photoreceptor is reversed. The most preferable photosensitive layer configuration is the negatively charged photoreceptor configuration having said function separation structure.

The width of the cylindrical organic photoreceptor is a length, along with the central axis of the cylindrical organic photoreceptor, of area on which layers working as a photoreceptor are provided. The area having a part of the layers is provided is excluded from the area of photoreceptor as far as it does not work as the photoreceptor.

The photosensitive layer configuration of a function separated negatively charged photoreceptor is now described.

Charge Generating Layer

The charge generating layer comprises charge generating materials (CGM). As to other materials, if desired, binder resins and other additives may be incorporated.

For example, employed may be phthalocyanine pigments, azo pigments, perylene pigments, azulenium pigments, and the like. Of these, CGMs, which are capable of minimizing the increase in residual potential, accompanied under repeated use, are those which comprise a three-dimensional electrical potential structure capable of taking stable agglomerated structure between a plurality of molecules. Specifically listed are CGMs of phthalocyanine pigments and perylene pigments having a specific crystal structure. For instance, titanyl phthalocyanine having a maximum peak at 27.2° of Bragg angle 2θ with respect to a Cu-Kα line, benzimidazole perylene having a maximum peak at 12.4° of said Bragg 2θ, and the like, result in minimum degradation under repeated use and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As to other materials, if desired, also incorporated may be additives such as antioxidants and the like.

Various charge transfer materials (CTM) may be employed. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole.

The most preferable as CTL binders are polycarbonate resins. Polycarbonate resins are most preferred because the dispersibility of CTM as well as electrophotographic properties is improved. In the case of the photoreceptor in which the charge transport layer is employed as the protect layer, polycarbonates which exhibit high mechanical wear resistance are preferred and polycarbonates having an average molecular weight of at least 40,000 are also preferable. The ratio of binder resins to charge transport materials is preferably between 10 and 200 weight parts per 100 weight parts of the binder resins. Further, the thickness of the charge transport layer is preferably between 10 and 35 μm.

Protective Layer

Provided as protective layers of a photoreceptor may be various types of resin layers. Specifically, it is possible to obtain the photoreceptor having high mechanical strength by providing a cross linked resin layer.

Preferred as electrophotographic photoreceptors of the present invention, which exhibit high hardness, are those in which a resin layer comprising siloxane based resins, having structural units exhibiting charge transportability, is used as the protective layer.

The siloxane based resin is obtained by subjecting dehydration condensation to hydrolysis product of hardenable organic silicone compound. The siloxane based resin layer is formed by applying a coating composition prepared by employing organic silicon compounds represented by General Formula (1), described below, as the raw materials and subsequently drying said coated layer. These raw materials undergo hydrolysis in a hydrophilic solvent and subsequently result in a condensation reaction. Thus, they form condensation products (oligomers) of organic silicon compounds in a solvent. By applying these coating compositions onto a substrate and subsequently drying the resultant coated layer, it is possible to form a resin layer comprising siloxane based resins forming a three-dimensional net structure.

General Formula (1)

$$(R)_n—Si—(X)_{4-n}$$

wherein R represents an organic group in which a carbon atom directly bonds to a silicon atom, X represents a hydroxyl group or a hydrolyzable group, and n represent an integer of 0 to 3.

In organic silicon compounds represented by General Formula (1), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl)ethyl, and the like; an acryloyl or methacryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β (aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolizable groups represented by X are an alkoxy group such as methoxy, ethoxy, and the like, a halogen atom, and an acyloxy group. Specifically preferred are alkoxy groups having not more than 6 carbon atoms.

Further, organic silicon compounds represented by General Formula (1) may be employed individually or in combinations of two or more types. However, it is preferable to employ at least one type of organic silicon compounds represented by General Formula (1), in which n is 0 or 1.

Further, in the specific organic silicon compounds represented by General Formula (1), when n is at least 2, a plurality of R may be the same or different. In the same manner, when n is not more than 2, a plurality of X may be the same or different. Still further, when at least two types of organic silicon compounds represented by General Formula (1) are employed, R and X, in each compound, may be the same or different.

Examples of compound n being 1 include trichlorosilane, methyltrichlorosilane, vinyltrichlorosilane, ethyltrichlorosilane, allyl trichlorosilane, n-propyl trichlorosilane, n-butyl trichlorosilane, chloromethyl trichlorosilane, methyl trimethoxysilane, mercaptotrimethyl trimethoxysilane, trimethoxyvinylsilane, ethyltrimethoxysilane, 3,3,4,4,5,5,6,6,6-nonafluorohexyl trichlorosilane, phenyl trichlorosilane, 3,3,3-trifluoro propyl trimethoxysilane, 3-chloropropyl trimethoxysilane, triethoxysilane, 3-mercapto propyltrimethoxysilane, 3-aminopropyltrimethoxysilane, 2-aminoethylaminomethyltrimethoxysilane, benzyl triethoxysilane, methyl triacetoxysilane, chloromethyl triethoxysilane, ethyl triacetoxysilane, phenyl trimethoxysilane, 3-allylthiopropyl trimethoxysilane, 3-glycidoxypropyl trimethoxysilane, 3-bromo propyl triethoxysilane, 3-allylamino propyl trimethoxysilane, propyltriethoxysilane, hexyltrimethoxysilane, 3-aminopropyl triethoxysilane, 3-methacryloxypropyl trimethoxysilane, bis(ethylmethylketoxime) methoxymethyl silane, pentyl triethoxysilane, octtyl triethoxysilane, and dodecyl triethoxysilane.

Examples of compound n being 2 include dimethyldichlorosilane, dimethoxy methylsilane, dimethoxy dimethylsilane, methyl-3,3,3-trifluoropropyl dichlorosilane, diethoxymethylsilane, dimethoxymethyl-3,3,3-trifluoropropyl silane, 3-chloropropyl dimethoxymethyl silane, chloromethyl diethoxysilane, dimethoxy-3-mercaptopropylmethylsilane, 3,3,4,4,5,5,6,6,6-nonafluorohexylmethyl dichlorosilane, methylphenyl dichlorosilane, diacetoxy methylvinylsilane, diacethoxy methylvinylsilane, diethoxy methylvinylsilane, 3-methacryloxypropylmethyl dichlorosilane, 3-aminopropyldiethoxy methylsilane, 3-(2-aminoethylaminopropyl)dimethoxymethylsilane, t-butylphenyl dichlorosilane, 3-methacryloxypropyldimethoxymethylsilane, 3-(3-cyanopropylthiopropyl)dimethoxymethylsilane, 3-(2-acetoxyethylthiopropyl)dimethoxymethylsilane, dimethoxymethyl-2-piperidinoethylsilane, dibutoxydimethylsilane, 3-dimethylaminopropyl diethoxymethylsilane, diethoxymethylphenylsilane, diethoxy-3-glycidoxypropyl methylsilane, 3-(3-acetoxypropylthio)propyldimethoxymethylsilane, dimethoxymethyl-3-piperidinopropylsilane, and diethoxymethyl octadecylsilane.

The most preferable protective layer is a siloxane based resin layer which has as itself transportable characteristics, low surface free energy, and improved adhesiveness to the neighbor layer and brittleness.

Example of the protective layer is a siloxane based resin layer containing a charge transportable structural unit and cross-linking structure. It is possible to minimize an increase in the residual potential of said resin layer, which is comprised of siloxane based resins having structural units having charge transportability which are prepared utilizing condensation reaction of said organic silicon compounds or condensation products thereof with the compounds represented by General Formula (2) described below.

General Formula (1)

$$B—(R_1—ZH)_m$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

B of General Formula (2) is a univalent group comprising a charge transportable compound structure. Comprising a charge transportable compound structure, as described herein, means that the compound structure obtained by excluding a $R_1$—ZH group in General Formula (2) possesses charge transportability or a compound represented by BH, which is obtained by substituting $R_1$—ZH in the aforementioned General Formula (2) with a hydrogen atom, possesses charge transportability.

The charge transportable compound has drift mobility of an electron or a hole. The charge transportable compound may be defined by which an electric current caused by charge transportation can be detected by a known method for detecting the charge transportation ability such as Time-Of-Flight method.

The protective layer containing a structural unit having charge transportability in the siloxane based resin layer can be formed by condensation reaction of the organic silane compound with the compound having charge transportability. The protective layer also can be formed by employing a compound reactive with the organic silicone compound having transportability in place of the charge transportable compound represented by Formula (2).

It is preferable to incorporate inorganic metal oxide particles having particle size of from 5 to 50 nm in the siloxane based resin layer. In other words, the preferable resin layer is formed by coating, and drying thereafter, a composition comprising an organic silicone compound having a hydroxy group or hydrolyzable group, or a charge transportable compound having said condensation product of the organic silicon compound with hydroxy group, and the inorganic metal oxide particles.

The inorganic particles having particle size of from 5 to 500 nm is usually synthesized by a liquid phase process. Examples of the metal atom for the inorganic particles include Si, Ti, Al, Cr, Zr, Sn, Fe, Mg, Mn, Ni, and Cu. The metal oxide of these metals are obtained as colloid particles.

The metal oxide particles preferably comprises a chemical group reacting with the organic silicone compound on the surface of the particles. The example of the reacting chemical group includes hydroxy and amino. The siloxane based resin and the metal oxide particles form a composite siloxane based resin layer in which the siloxane based resin and the surface of the metal oxide particles make chemical bonding, and a protect layer having enhanced mechanical strength as well as elasticity is obtained. The protective layer is hard to wear against abrasion such as blade cleaning and gives good electrophotographic characteristics.

The composition ratio of the total weight (H) of the condensation product formed from said organic silicon compound, having a hydroxyl group or hydrolyzable group, and an organic silicon compound, having a hydroxyl group or a hydrolyzable group, to the composition of compound (I) represented by the aforementioned General Formula (1) is preferably between 100:3 and 50:100 in terms of the weight ratio, and is more preferably between 100:10 and 50:100.

Colloidal silica or other metal oxides may be added. When colloidal silica or other metal oxides (J) are added, 1 to 30 weight parts of (J) is preferably employed with respect to 100 parts of said total weight (H) plus the weight of compound (I) component.

When a component, having said total weight (H), is employed within said range, the protect layer of the photoreceptor of the present invention exhibits high hardness as well as sufficient elasticity.

Thee siloxane resin layer is dried at preferably 80° C. or more and the layer is preferably subjected to post heating after the drying at 30 to 100° C. in the preparation process.

When said siloxane based resin layer is formed, in order to enhance condensation reaction, condensation catalysts are preferably employed. The condensation catalysts employed herein may be those which either catalytically act on condensation reaction or move the reaction equilibrium of the condensation reaction in the reaction proceeding direction.

Employed as specific condensation catalysts may be those known in the art such as acids, metal oxides, metal salts, alkyl aminosilane compounds, and the like, which have conventionally been employed in silicone hard coat materials. For example, listed may be alkali metal salts of organic carboxylic acids, nitrous acid, sulfurous acid, aluminic acid, carbonic acid, and thiocyanic acid; organic amine salts (tetramethylammonium hydroxide, tetramethylammonium acetate), tin organic acid salts (stannous octoate, dibutyl tin acetate, dibutyl tin dilaurate, dibutyl tin mercaptide, dibutyl tin thiocarboxylate, dibutyl tin maliate, and the like; and the like.

Example of compounds represented by General Formula (2) are listed below.

(B-1)

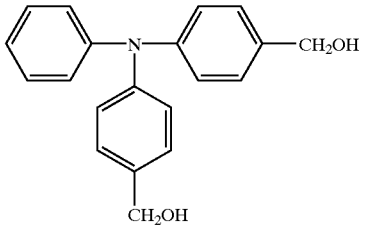

-continued (B-2)

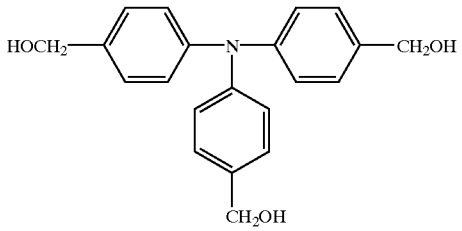

(B-3)

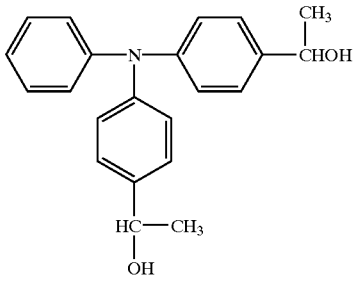

(B-4)

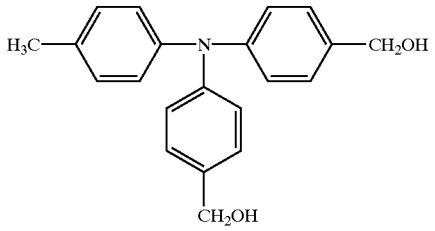

(B-5)

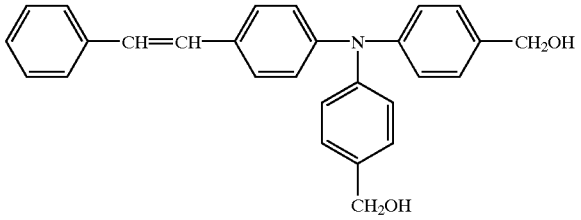

(B-6)

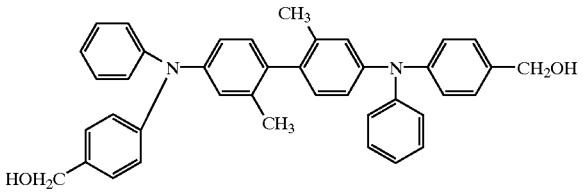

(B-7)

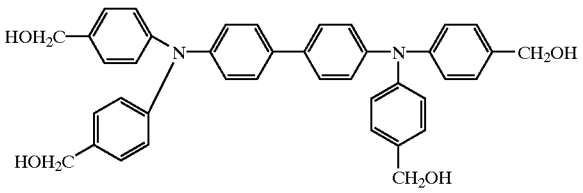

-continued (B-8)

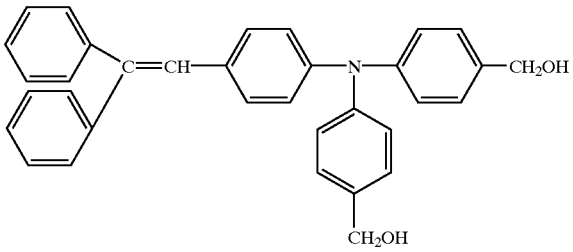

(B-9)

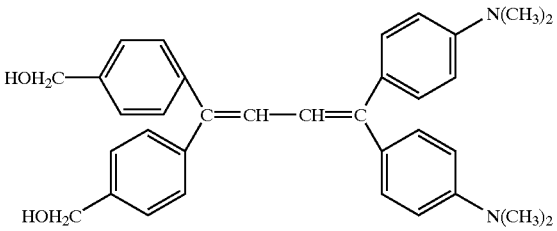

(B-10)

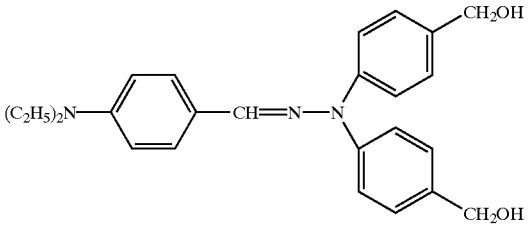

(B-11)

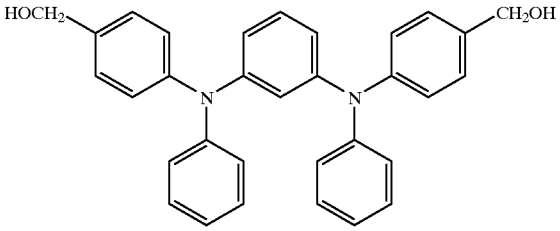

(B-12)

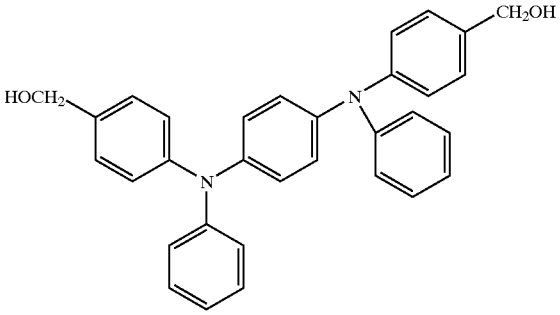

(B-13)

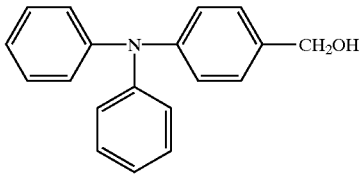

-continued (B-14)

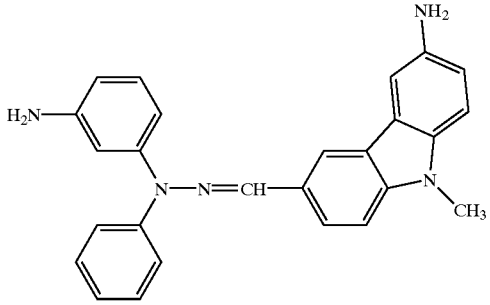

(B-15)

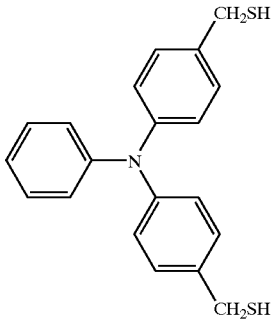

Further, it is possible to effectively minimize the increase in residual potential as well as image blurring by adding antioxidants to the protect layer of said siloxane based resin. The antioxidants, as described herein, means materials as representative ones, which minimize or retard the action of oxygen under conditions of light, heat, discharging, and the like, with respect to auto-oxidation occurring materials which exist in the electrophotographic photoreceptor or the surface thereof. Specifically, a group of such compounds described below is listed.

1-1

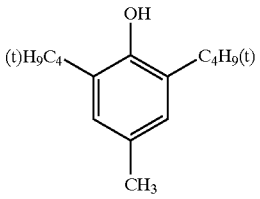

1-2

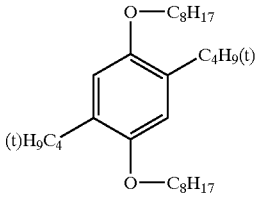

1-3

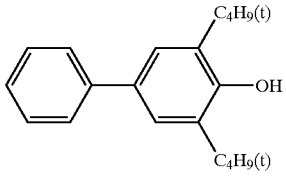

-continued 1-4

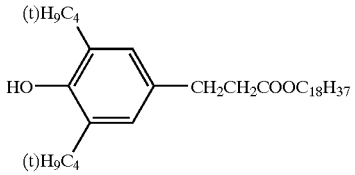

1-5

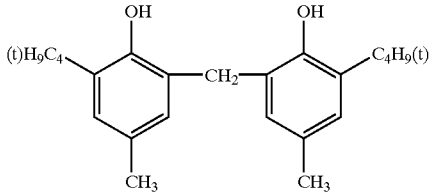

1-6

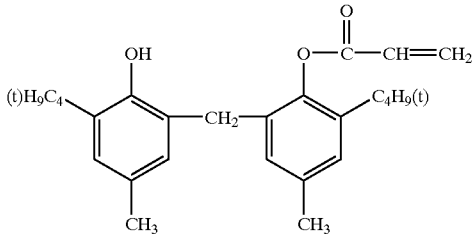

1-7

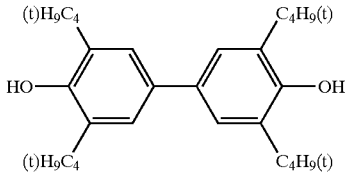

1-8

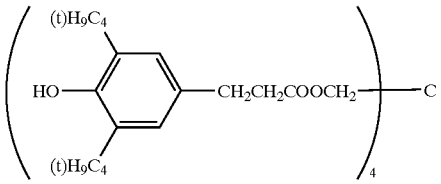

1-9

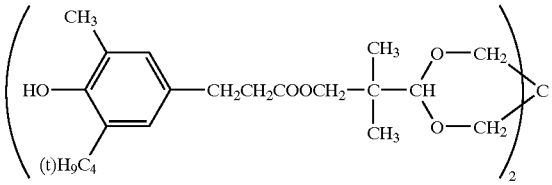

1-10

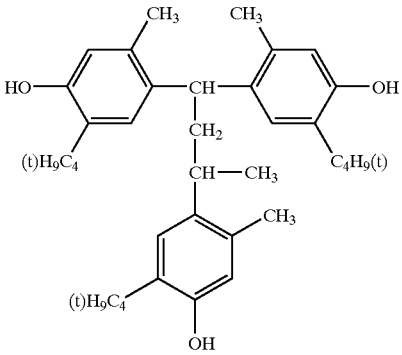

-continued 2-1

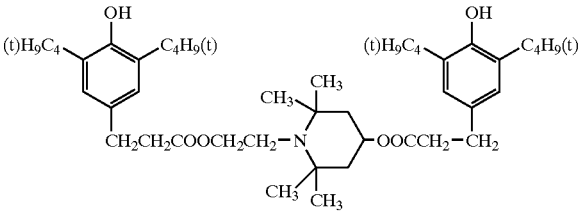

2-2

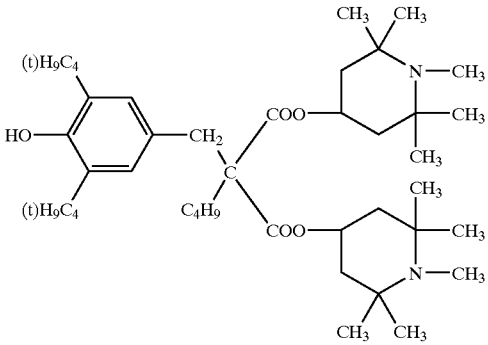

2-3

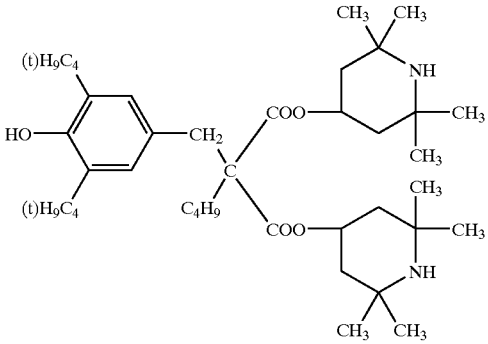

It is advantageous to incorporate a compound having a fluorine atom in the protective layer to reduce the surface energy of the photoreceptor so as to reduce the adhesion strength of toner to the photoreceptor. Preferable example of the compound is fluorinate polymer, fluoride resin particles, and so on. The compound is employed preferably from 3 to 50% by weight with reference to the whole weight of the protective layer.

Dried thickness of the protective layer, which depends on the characteristics of the photoreceptor as a whole such as electrostatic characteristics, anti-abrasion characteristics and so on, is preferably 0.2 to 10 mm when the protective layer is formed by the siloxane based resin.

Solvents, which are employed to form layers such as an inter layer, photosensitive layer a protective layer, include n-butylamine, diethyl amine, ethylene diamine, isopropanol amine, triethanol amine, triethylenediamine, N,N-dimethylformamide, acetone, methyl ethyl ketone, methyl-isopropyl ketone, cyclohexanone, benzene, toluene, xylene, chloroform, dichloromethane, 1,2-dichloroethane, 1,2-dichloropropane, 1,1,2-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and so on. Dichloromethane, 1,2-dichloroethane, and methylethyl ketone are preferably employed among these. These may be employed individually or in combination.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the protect layer side of the photosensitive layer, as well as to achieve uniform coating, the spray coating method or the circular amount control type coating method (being a circular slide hopper type as its representative example) is preferably employed. The above-mentioned circular amount control type coating is described in, for example, Japanese Patent Publication Open to Public Inspection No. 58-189061.

The preparation method of the photoreceptor having ratio 80/100 to 99/100 of width of photosensitive layer to length of the cylindrical electroconductive substrate is described.

The substrate is processed to have predetermined size, and a photosensitive layer with desired width is formed, or a part of the photosensitive layer is removed at the end sides, so as to have the ratio of the width of the photosensitive layer of the photoreceptor to the length of the cylindrical electroconductive substrate satisfying 80/100 to 99/100.

Examples of the methods to remove a part of the photosensitive layer include those, such as, removing by ultrasonic wave as described in JPA 59-142555, removing by brush as described in JPA 60-97861, removing by a scraper as described in JPA 61-222571, and so on. The other and preferable way is that tape shaped material containing solvent is pressed to the photosensitive layer so as to remove it.

Described next will be the toner which is employed in the present invention.

Preferred as the toner of the present invention is a polymerized toner in which the size distribution of individual toner particles as well as their shape is relatively uniform. The polymerized toner as described herein means a toner obtained in such a manner that binder resins for the toner as well the shape of toner particles are formed by polymerization of monomers as the raw materials of the binder resins followed by chemical treatment. More specifically, said polymerized toner means the toner which is obtained by polymerization such as suspension polymerization, emulsion polymerization and the like, if desired, followed by a fusing process among particles which is carried out after said polymerization.

Preferred as the polymerized toner which is employed in the cleaning unit employing the first blade member of the present invention is one having a specific shape of toner particles. The polymerized toner, which may preferably be employed in the present invention, will be described below.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. In the present invention, it has been discovered that even though such a polymerized toner is employed, it is possible to stabilize the vibration of the first blade member, and excellent cleaning performance is exhibited.

Further, the stability of the vibration of the first blade member is dependent on the diameter of toner particles. As the diameter of particles decrease, adhesion of toner particles to the image bearing body increases. As a result, the resultant vibration tends to become excessive, and toner particles are more likely not to be removed by the first blade member. On the other hand, toner particles, having a larger diameter, are more readily removed by the first blade member. However, problems occur in which image quality such as resolution, and the like, is degraded.

Investigation was carried out based on the aforementioned viewpoints. As a result, it has been discovered that by employing a toner having a variation coefficient of the toner shape coefficient of not more than 16 percent, as well as having a number variation coefficient in the toner number size distribution of not more than 27 percent, high image quality, which is exhibited by excellent cleaning properties, as well as excellent fine line reproduction, can be obtained over an extended period of time.

Further, by employing a toner in which the number ratio of toner particles, having no corners, is set at 50 percent or more and the number variation coefficient in the number size distribution is adjusted to not more than 27 percent, it is possible to obtain high image quality over an extended time of period, which exhibits excellent cleaning properties, as well as excellent fine line reproduction.

The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

The polymerized toner of the present invention is that the number ratio of toner particles in the range of the shape coefficient of 1.2 to 1.6 is preferably at least 65 percent and is more preferably at least 70 percent.

By adjusting the number ratio of toner particles in the range of a shape coefficient of 1.2 to 1.6 to at least 65 percent, the triboelectrical properties become more uniform on the developer conveying member resulting in no accumulation of excessively charged toner particles, and said toner particles are more readily replaced from the surface of said developer conveying member to minimize the generation of problems such as development ghost and the like. Further, the toner particles tend not to be crushed, resulting in decreased staining on the charge providing member and chargeability of the toner is stabilized.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The variation coefficient of the polymerized toner, which is preferably employed in the present invention, is calculated using the formula described below:

$$\text{Variation coefficient}=(S/K)\times 100 \text{ (in percent)}$$

wherein S represents the standard deviation of the shape coefficient of 100 toner particles and K represents the average of said shape coefficient.

The variation coefficient of the shape coefficient is generally not more than 16 percent, and is preferably not more than 14 percent. By adjusting said variation coefficient of the shape coefficient to not more than 16 percent, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and $D_n$ represents the number average particle diameter (in $\mu$m).

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The toner particles of the present invention, which substantially have no corners, as described herein, mean those having no projection to which charges are concentrated or which tend to be worn down by stress. Namely, as shown in FIG. 9(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 9(*b*) and 9(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

In order to obtain toner having no corners, for example, as previously described as the method to control the shape coefficient, it is possible by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, ISOTON R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Of methods to control the shape coefficient, the polymerized toner method is preferable since it is simple as well as convenient as a toner production method, the surface uniformity is excellent compared to pulverized toner, and the like.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

The water based medium as described in the present invention means one in which at least 50 percent, by weight of water, is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . . . After completing the reaction, the dispersion stabilizers are removed, filtered, washed, and subsequently dried. In this manner, the toner of the present invention is prepared.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

Employed coagulants are, for example, selected from metal salts suitably. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others. Based on said publication, it is possible to obtain detailed critical coagulation concentration. Further, as another method, a specified salt is added to a targeted particle dispersion while varying the concentration of said salt; the ξ potential of the resultant dispersion is measured, and the critical coagulation concentration is also obtained as the concentration at which said ξ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

In order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are known in the art and can be dispersed in water. Specifically listed is Nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Figure 4:
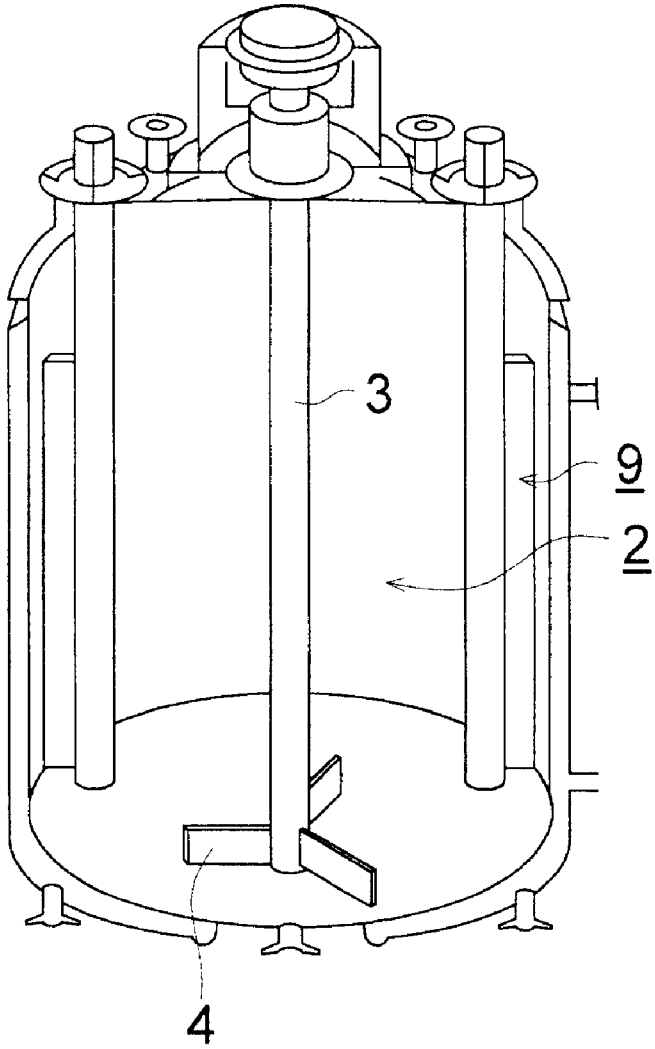
FIG. 4 is a view explaining a reaction apparatus having one level configuration of the stirring blade.

FIG. 4 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 4, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 5:
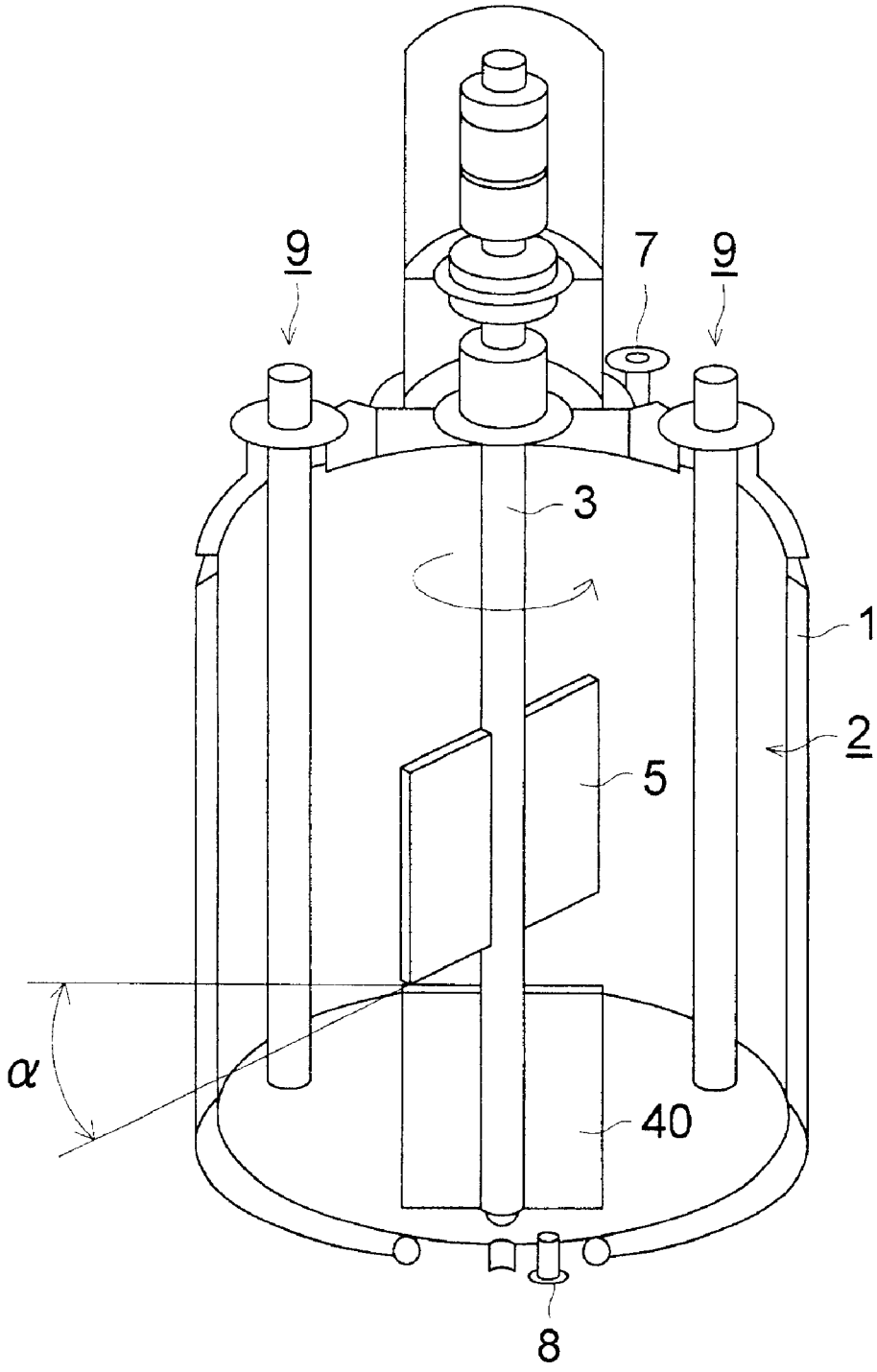
FIG. 5 is a perspective view showing one example of a reaction apparatus which is provided with preferably employable stirring blades.
Figure 6:
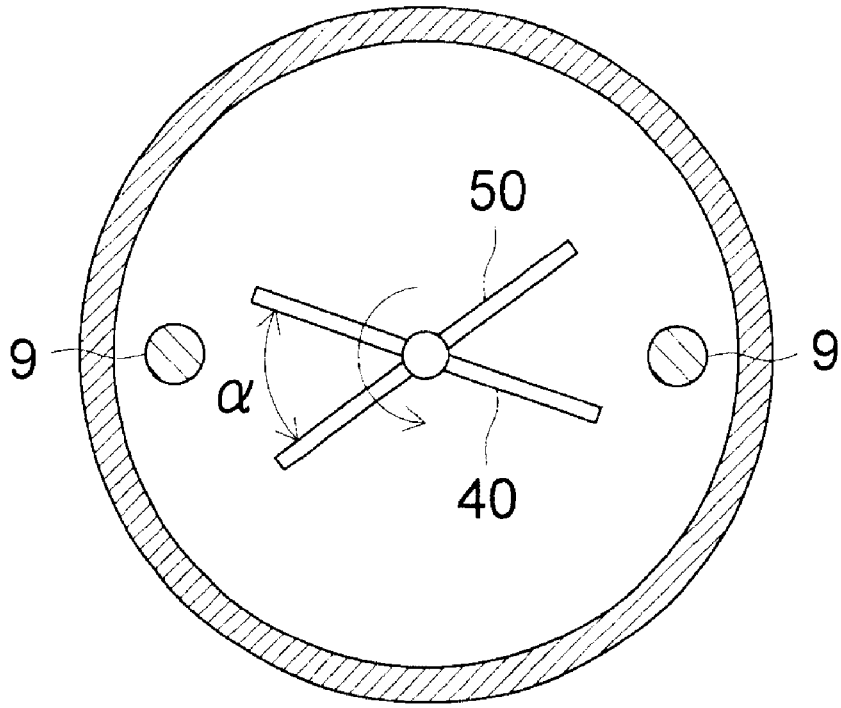
FIG. 6 is a cross-sectional view of the reaction apparatus shown in FIG. 5.

FIGS. 5 and 6 are a perspective view and a cross-sectional view, of the reaction apparatus described above, respectively. In the reaction apparatus illustrated in FIGS. 5 and 6, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

Incidentally, in FIGS. 5 and 6, arrows show the rotation direction, reference numeral 7 is upper material charging inlet, 8 is a lower material charging inlet, and 9 is a turbulent flow forming member which makes stirring more effective.

Figure 8:
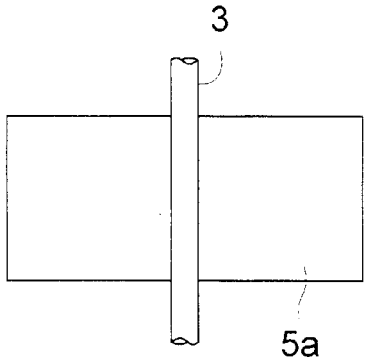
FIG. 8 is a view showing a specific example of stirring blade form.
Figure 8:
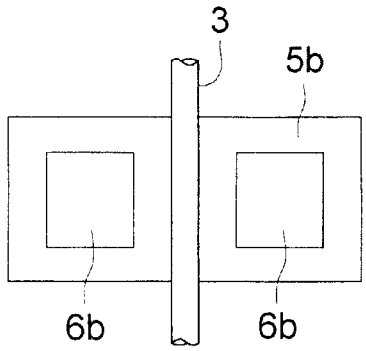
Figure 8:
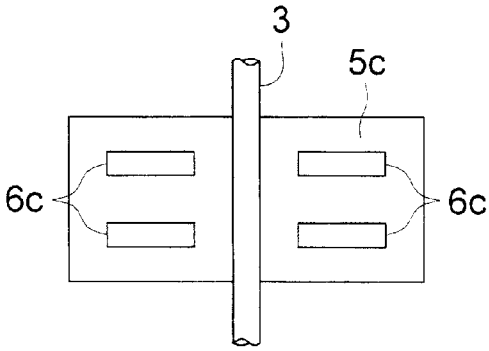
Figure 8:
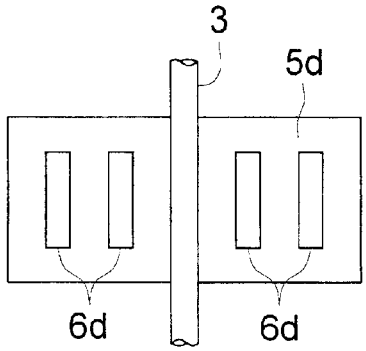

Herein, the shape of the stirring blades is not particularly limited, but employed may be those which are in square plate shape, blades in which a part of them is cut off, blades having at least one opening in the central area, having a so-called slit, and the like. FIGS. 8(*a*) through 8(*d*) describes specific examples of the shape of said blades. Stirring blade 5*a* shown in FIG. 8(*a*) has no central opening; stirring blade 5*b* shown in FIG. 8(*b*) has large central opening areas 6*b*; stirring blade 5*c* shown in FIG. 8(*c*) has rectangular openings 6*c* (slits); and stirring blade 5*d* shown in FIG. 8(*d*) has oblong openings 6*d* shown in FIG. 8(*d*). Further, when stirring blades of a three-level configuration are installed, openings which are formed at the upper level stirring blade and the openings which are installed in the lower level may be different or the same.

Figure 7:
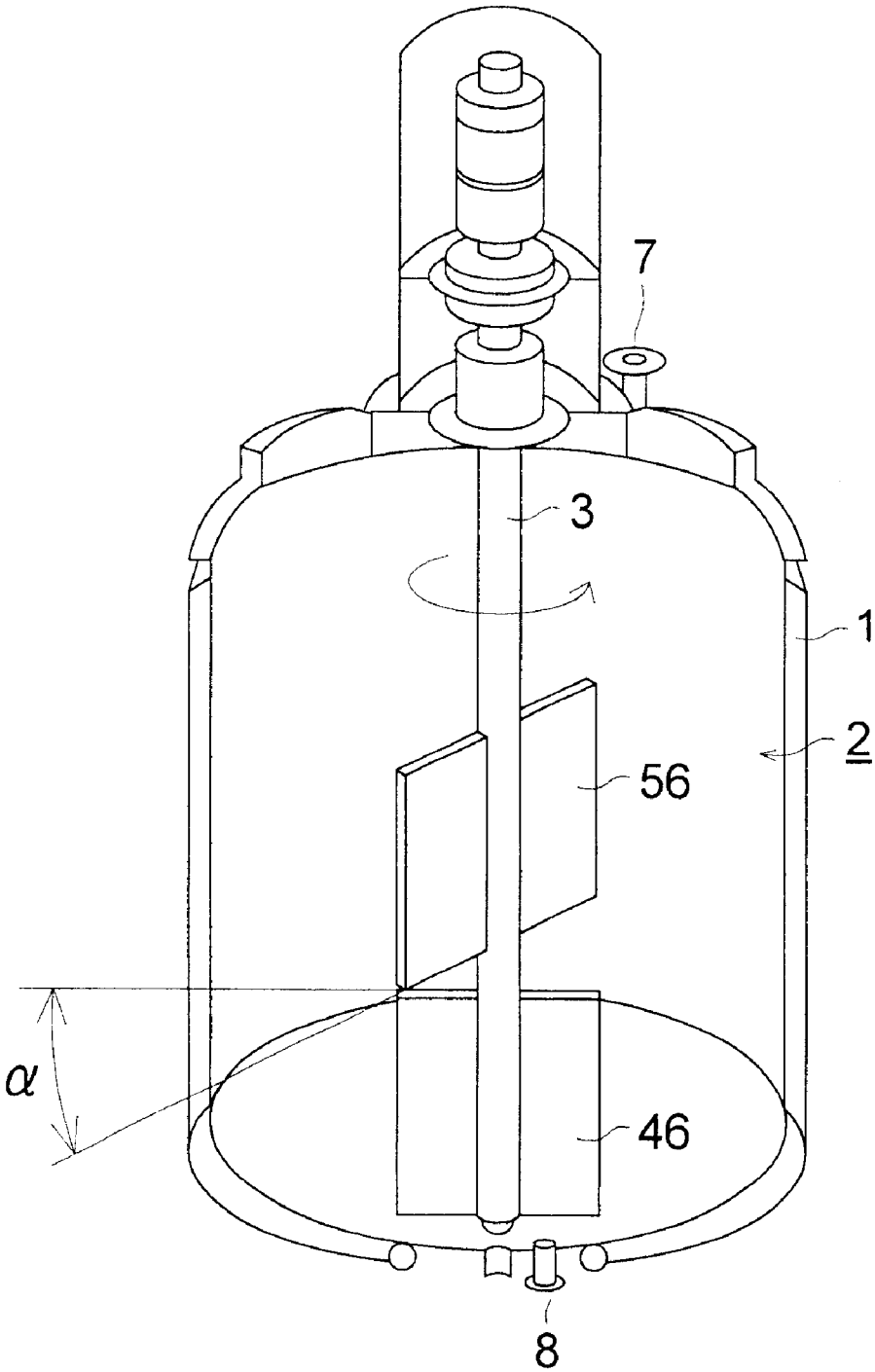
FIG. 7 is a perspective view showing one example of a reaction apparatus employed so that a laminar flow forms.

Still further, FIG. 7 shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56, has the same shape as well as the crossed axis angle of stirring blade 40, as well as stirring blade 50 which constitutes part of the reaction apparatus shown in FIG. 5. In FIG. 7, reference numeral 1 is a heat exchange jacket, 2 is a stirring tank, 3 is a rotation shaft, 7 is an upper material charging inlet, and 8 is a lower material charging inlet.

The apparatuses other than one shown in FIG. 7 may be employed to form a laminar flow.

Further, the shape of stirring blades, which constitute part of said reaction apparatuses, is available as long as they form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

More in detail, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 7. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle α in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 8(*a*), which are formed of a continuous plane are preferable, and those having a curved plane may also be employed.

The toner of the invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

Employed as external additives which are used in the present invention may be fatty acid metal salts. Cited as fatty acids and salts thereof are long chain fatty acids such as undecylic acid, lauric acid, tridecyl acid, dodecyl acid, myristic acid, palmitic acid, pentadecylic acid, stearic acid, heptadecylic acid, arachic acid, montanic acid, oleic acid, linoleic acid, arachidonic acid, as well as their salts of metals such as zinc, iron, magnesium, aluminum, calcium, sodium, lithium and the like. In the present invention, zinc stearate is particularly preferable.

A two-component developer is prepared by mixing a toner with a carrier. The concentration of the toner in the developer is to be between 2 and 10 percent by weight, and the resultant developer is employed.

Development methods according to the present invention are not particularly limited. A contact development method may be employed in which development is carried out in such a manner that the photoreceptor surface comes into contact with the developer layer, and a non-contact development method may also by employed in which the photoreceptor surface and the developer layer are maintained in a non-contact state, and development is carried out by allowing the toner jump in the space between the photoreceptor surface and the developer layer, employing means such as an alternating electrical field and the like.

EXAMPLES

The present invention will now be detailed with reference to examples. In the followings, "parts" means "parts by weight", unless otherwise specified.

Photoreceptor 1 was prepared as follows.

Preparation of Photoreceptor P1

| <Subbing layer> | |
|---|---|
| Titanium chelate compound TC-750 (Matsumoto Seiyaku Co., Ltd.) | 30 g |
| Silane coupling agent KBM-503 (Shin'etsu Kagaku Co., Ltd.) | 17 g |
| 2-propanol | 150 ml |

The above coating liquid was coated on an electroconductive cylindrical substrate having a diameter of 100 mm so that the layer thickness is 0.5 μm.

| <Charge generation layer> | |
|---|---|
| Y-type titanylphthalocyanine having the maximum peak of Bragg angle 2θ(±0.2) at 27.7° in Cu—Kα X-ray diffraction spectrum | 60 g |
| 2-butanone | 2000 ml |

The above-mentioned were mixed and dispersed for 10 hours by a sand mill to prepare a charge generation layer coating liquid. The coated liquid was coated method so as to form a charge generation layer with a thickness of 0.2 μm.

| <Charge transportation layer> | |
|---|---|
| Charge transportable substance, N-(4-methylphenyl)-N-{4-(β-phenylstylyl)phenyl}-p-toluidine | 225 g |
| Polycarbonate (Viscosity average molecular weight: 30,000) | 300 g |
| Antioxidant (Exemplified compound 1–3) | 6 g |
| Dichloromethane | 2000 ml |

The above-mentioned were dissolved to prepare a charge transportation layer coating liquid. The coating liquid was coated on the charge generation layer by an immersion coating method so as to form a charge transportation layer with a thickness of 20 μm.

| <Protect layer> | |
|---|---|
| Methyl trimethoxy siloxane | 150 g |
| Dimethyl trimethoxysilane | 30 g |
| Reactive charge transportable compound (Exemplified compound B-1) | 15 g |
| Antioxidant (Exemplified compound B-1) | 0.75 g |
| 2-propanol | 75 g |
| 3% acetic acid | 5 g |

The above-mentioned were mixed to prepare a coating solution of the resin layer. The coating liquid was coated on the foregoing charge transportation layer by a disk quantity regulation coating apparatus so as to form a resin layer with a thickness of 2 μm. The coated layer was thermally hardened by heating for 1 hour at 120° C. to form a siloxane resin layer. Thus Photoreceptor 1 was prepared.

Preparation of Photoreceptor 2

Photoreceptor 2 was prepared in the same manner as in photoreceptor 1 except that the protect layer was prepared as follow.

| | |
|---|---|
| Methyl trimethoxy siloxane | 150 g |
| Dimethyl trimethoxysilane | 30 g |
| Reactive charge transportable compound (Exemplified compound B-1) | 15 g |
| Polyvinilydenfluoride particles having average volume particle diameter of 0.2 μm | 10 g |
| Antioxidant (Exemplified compound B-1) | 0.75 g |
| 2-propanol | 75 g |
| 3% acetic acid | 5 g |

The above-mentioned were mixed to prepare a coating solution of the resin layer. The coating liquid was coated on the foregoing charge transportation layer by a disk quantity regulation coating apparatus so as to form a resin layer with a thickness of 2 μm. The coated layer was thermally hardened by heating for 1 hour at 120° C. to form a siloxane resin layer. Thus Photoreceptor 2 was prepared.

Photoreceptors A to f were prepared by that coating at both sides of the end portion of the photoreceptor 1 or 2 was removed by pressing tape containing dichloromethane as shown Table 1.

TABLE 1

| Photo-receptor | Photo-sensitive layer | Removed length at x end (mm) | Removed length at y end (mm) | Ratio of width of photosensitive layer to width of substrate |
|---|---|---|---|---|
| A | P1 | 50 | 34 | 78/100 |
| B | P1 | 48 | 20 | 82/100 |
| C | P1 | 20 | 18 | 90/100 |
| D | P1 | 4 | 4 | 98/100 |
| E | P1 | 0 | 0 | 100/100 |
| F | P2 | 20 | 18 | 90/100 |

The photoreceptor was installed in the image forming apparatus so that the end sides x and y were right and left sides respectively with reference to the rotation direction of the photoreceptor.

Toner employed in the present invention was prepared as described below.

Production of Toners T1 through T5 (Example of Emulsion Polymerization Method)

Added to 10.0 liters of pure water was 0.90 kg of sodium dodecyl sulfate, which was dissolved while stirring. Gradually added to the resultant solution were 1.20 kg of Regal 330R (carbon black, manufactured by Cabot Co.), and stirred well for one hour. Thereafter, the resultant mixture was continuously dispersed for 20 hours, employing a sand grinder (a medium type homogenizer). The resultant dispersion was designated as "Colored Dispersion 1". Further, a solution comprised of 0.055 kg of sodium dodecylbenzenesulfonate and 4.0 liters of deionized water was designated as "Anionic Surface Active Agent Solution A".

A solution comprised of 0.014 kg of nonyl phenyl polyethylene oxide 10-mole addition product and 4.0 liters of deionized water was designated as "Nonionic Surface Active Solution B". A solution prepared by dissolving 223.8 g of potassium persulfate in 12.0 liters of deionized water was designated as "Initiator Solution C".

Placed into a 100-liter GL (glass lining) reaction tank, fitted with a thermal sensor, a cooling pipe, and a nitrogen gas introducing device, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution A", and all of "Nonionic Surface Active Agent B", and the resultant mixture was stirred. Subsequently, 44.0 liters of deionized water were added.

When the mixture was heated to 75° C. all of "Initiator Solution C" was added dropwise. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added dropwise. After finishing dropwise addition, the mixture was heated to 80±1° C. and stirred for 6 hours while being heated. Subsequently the resultant mixture was cooled to not more than 40° C., and stirring was terminated. Said mixture was filtered employing a pole filter and the resultant filtrate was designated as "Latex (1)-A".

The glass transition temperature of resinous particles in Latex (1)-A was 57° C., and the softening point of the same was 121° C. The molecular weight distribution of the same exhibited parameters such as a weight average molecular weight of 12,700 and a weight average particle diameter of 120 nm.

A solution, prepared by dissolving 0.055 kg of sodium dodecylbenzene sulfonate in 4.0 liters of deionized water, was designated as "Anionic Surface Active Agent Solution D". Still further, a solution prepared by dissolving 0.014 kg of nonyl phenol polyethylene oxide 10-mole added product in 4.0 liters of deionized water was designated as "Nonionic Surface Active Agent Solution E".

A solution, prepared by dissolving 200.7 g of potassium persulfate (manufactured by Kanto Kagaku Co.) in 12.0 liters of deionized water, was designated as "Initiator Solution F".

Placed into a 100-liter GL reaction tank, fitted with a thermal sensor, a cooling pipe, a nitrogen gas introducing device, and a comb-shaped baffle, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution D", and all of "Nonionic Surface Active Agent E", and the resultant mixture was stirred. Subsequently, 44.0 liters of deionized water were added. When the mixture was heated to 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. Thereafter, while maintaining the temperature of the mixture at 72±2° C., stirring was carried out for 6 hours while being heated. The temperature was further raised to 80±2° C., and stirring was carried out for 12 hours while being heated. The resultant solution was cooled to not more than 40° C., and stirring was terminated. Filtration was carried out employing a pole filter, and the resultant filtrate was designated as "Latex (1)-B.

The glass transition temperature of resinous particles in Latex (1)-B was 58° C., and the softening point of the same was 132° C. The molecular weight distribution of the same exhibited parameters such as a weight average molecular weight of 245,000 and a weight average particle diameter of 110 nm.

A solution, prepared by dissolving 5.36 kg of sodium chloride as the salting-out agent in 20.0 liters of deionized water, was designated as "Sodium Chloride Solution G".

A solution, prepared by dissolving 1.00 g of a fluorine based nonionic surface active agent in 1.00 liter of deionized water, was designated as "Nonionic Surface Active Agent Solution H".

Placed into a 100-liter SUS reaction tank, fitted with a thermal sensor, a cooling pipe, a nitrogen gas introducing device, and a particle diameter and shape monitoring device (a reaction apparatus which is shown in FIG. 7 in which the crossed axis angle $\alpha$ is set at 20 degrees) were 20.0 kg of Latex (1)-A and 5.2 kg of Latex (1)-B prepared as described above, 0.4 kg of colorant dispersion, and 20.0 kg of deionized water and the resultant mixture was stirred. Subsequently, said mixture was heated at 40° C., which was added to Sodium Chloride Solution G, 6.00 kg of isopropanol (manufactured by Kanto Kagaku Co.) and Nonionic Surface Active Agent Solution H in said order. Thereafter, the mixture was set aside for 10 minutes and then heated to 85° C. over 60 minutes. At 85±2° C., the mixture was stirred from 0.5 to 3 hours, so that the particle diameter increased under salting-out/fusion. Subsequently, 2.1 liters of pure water was added, to terminate the increase in the particle diameter.

Placed into a 5-liter reaction vessel, fitted with a thermal sensor, a cooling pipe, and a particle diameter and shape monitoring device (Being the reaction apparatus which is shown in FIG. 11 in which the crossed axis angle $\alpha$ is set at 20 degrees) were 5.0 kg of the fused particle dispersion prepared as described above, and the shape was controlled while stirring at the dispersion temperature of 85±2° C. from 0.5 to 15 hours. Thereafter, the resultant dispersion was cooled to not more than 40° C. and stirring was terminated. Subsequently, classification was carried out in the suspension by a centrifugal sedimentation method employing a centrifuge, and the resultant mixture was filtered employing a 45 $\mu$m opening sieve. The resultant filtrate was designated as Association Liquid (1). Subsequently, wet cake-like non-spherical particles were collected from said Association Liquid (1) through filtration, employing glass filter and then washed with deionized water.

The resultant non-spherical particles were dried employing a flash jet drier at an intake air temperature of 60° C., and subsequently dried at 60° C., employing a fluidized-bed dryer. Externally blended with 100 parts, by weight, of the obtained colored particles were one part by weight of fine silica particles and 0.1 part by weight of zinc stearate, employing a Henschel mixer, and thus toners shown in the table below were obtained which were prepared employing the emulsion polymerization association method. Toner T1 through Toner T5 shown in Table 1 were obtained by controlling the stirring rotation rate and the heating time during monitoring of said salting-out/fusion stage as well as the shape controlling process, and further by adjusting the particle diameter and the variation coefficient of the grain size distribution.

Production of Toner T6 (Example of Suspension Polymerization Method)

A mixture consisting of 165 g of styrene, 35 g of n-butyl acrylate, 10 g of carbon black, 2 g of di-t-butylsalicylic acid metal compound, 8 g of styrene-methacrylic acid copolymer, and 20 g of paraffin wax (having an mp of 70° C.) was uniformly dissolved and dispersed at 12,000 rpm, employing TK Homomixer (manufactured by Tokushu Kikakogyo Co.). Added to the resultant mixture were 10 g of 2,2'-azobis(2,4-valeronitrile) and dissolved to prepare a polymerizable monomer composition. Subsequently, added to 710 g of deionized water were 450 g of 0.1 M aqueous sodium phosphate solution, and while stirring the resultant mixture at 13,000 rpm employing TK Homomixer, 68 g of 1.0 M calcium chloride were gradually added. Thus, a suspension, in which tricalcium phosphate was dispersed, was prepared. Added to the resultant suspension was said polymerizable monomer composition and the resultant mixture was stirred at 10,000 rpm for 20 minutes, employing TK Homomixer. Thus said polymerizable monomer composition was granulated. Thereafter, the granulated composition underwent reaction at 75 to 95° C. from 5 to 15 hours, employing a reaction apparatus having stirring blades (having a crossed axis angle of 45 degrees) structured as shown in FIG. 5. Subsequently, tricalcium phosphate was removed employing hydrochloric acid, and classification was then carried out in the liquid employing a centrifuge. Subsequently, filtering, washing and drying were carried out. Externally added to 100 weight parts of said obtained colored particles were one weight part of fine silica particle and 0.1 weight part of zinc stearate, employing a Henschel mixer. Thus obtained was a toner, which was prepared employing the suspension polymerization method.

Toner T6, which is shown in Table 2 described below, was obtained by carrying out monitoring during said polymerization, controlling the shape as well as the variation coefficient of the shape coefficient by controlling the temperature of said suspension, the rotation rate of stirring, and the heating time, and further by adjusting the particle diameter as well as the variation coefficient of the particle size distribution.

Production of Toner T7 (Example of Pulverization Method)

Hundred parts of styrene-acryl resin composed of 75 parts of styrene, 20 parts of butyl acrylate and 5 parts of butylmethacrylate by weight, 10 parts of carbon black and 4 parts of low molecular weight polypropylene having molecular weigh of 3,500 were melt and kneaded, then pulverized into fine particles by means of mechanical pulverizer, and the fine particles were subjected to classification by means of air classification machine to obtain Toner 7.

Characteristics of Toner 1 through 7 are Shown in Table 2.

TABLE 2

| Toner No. | Preparation method of toner | Ratio of Shape Coefficient of 1.2 to 1.6 (in percent) | Variation Coefficient of Shape Coefficient (in percent) | Ratio of Toner Particles having no Coroners (in percent) | Number Average Particle Diameter (in $\mu$m) | Variation Coefficient of Number Distribution (in percent) | Sum M of $m_1$ and $m_2$ (in percent) |
|---|---|---|---|---|---|---|---|
| T-1 | Emulsion polymerization association | 75.3 | 13.1 | 42.3 | 7.2 | 22.5 | 80.2 |
| T-2 | Emulsion polymerization association | 66.7 | 15.3 | 63.3 | 6.5 | 25.5 | 72.9 |

TABLE 2-continued

| Toner No. | Preparation method of toner | Ratio of Shape Coefficient of 1.2 to 1.6 (in percent) | Variation Coefficient of Shape Coefficient (in percent) | Ratio of Toner Particles having no Coroners (in percent) | Number Average Particle Diameter (in μm) | Variation Coefficient of Number Distribution (in percent) | Sum M of $m_1$ and $m_2$ (in percent) |
|---|---|---|---|---|---|---|---|
| T-3 | Emulsion polymerization association | 67.3 | 16.5 | 52.6 | 3.5 | 30.4 | 71.5 |
| T-4 | Emulsion polymerization association | 66.8 | 15.5 | 48.4 | 6.1 | 24.3 | 74.3 |
| T-5 | Emulsion polymerization association | 63.9 | 15.4 | 54.2 | 5.4 | 25.4 | 73.8 |
| T-6 | Suspension polymerization | 66.1 | 12.1 | 61.5 | 9.3 | 25.2 | 74.2 |
| T-7 | Polymerization | 62.3 | 18.5 | 42.7 | 6.5 | 32.5 | 62.6 |

Preparation of Developer

Preparation of Developer 1

Mixed with 100 parts of said T1 were 0.4 part of hydrophobic silica particles having an average particle diameter of 12 nm (R805, manufactured by Nihon Aerosil Co.) and 0.6 part of titania particles (T805, manufactured by Nihon Aerosil Co.), and the resultant mixture was blended at room temperature at a peripheral stirring blade rate of 40 m/second for 10 minutes to obtain a negatively charged toner. The sticking ratio of the resultant toner was 45 percent.

A ferrite carrier having a volume average particle diameter of 60 μm, which had been coated with silicon resins, was blended with said toner, and Developer 1, having a toner concentration of 5 percent, was prepared.

Preparation of Developers 2 through 7

Developer 2 was repapered in the same manner as Developer 1, except that in the preparation of said Developer 1, Toner T1 was replaced with Toner T2, while Developers 3 through 7 also prepared in the same manner, except that Toner T1 was replaced with Toners T3 through Toner T7, respectively.

Three species of cleaning blades available in the market were employed.

Cleaning Blade B1: (Hardness 70°, Impact Resilience 60%, Free length 9 mm, Thickness 2 mm, Length 310 mm)

Cleaning Blade B2: (Hardness 67°, Impact Resilience 50%, Free length 9 mm, Thickness 2 mm, Length 352 mm)

Cleaning Blade B3: (Hardness70°, Impact Resilience 28%, Free length 9 mm 2 mm, Length 378 mm)

Evaluation

TABLE 3

| Test No. | Photo-receptor | Toner No. | Blade contacting position (Central angle β in degree) | Blade sample No. | Blade Contact Angle (in degrees) | Blade Contact Load (in N/m) |
|---|---|---|---|---|---|---|
| 1 | A | T1 | 0 | B1 | 20 | 18 |
| 2 | B | T1 | 0 | B1 | 20 | 18 |
| 3 | C | T1 | 0 | B1 | 20 | 18 |
| 4 | D | T1 | 0 | B1 | 20 | 18 |
| 5 | E | T1 | 0 | B1 | 20 | 18 |
| 6 | F | T1 | 0 | B1 | 20 | 18 |

TABLE 3-continued

| Test No. | Photo-receptor | Toner No. | Blade contacting position (Central angle β in degree) | Blade sample No. | Blade Contact Angle (in degrees) | Blade Contact Load (in N/m) |
|---|---|---|---|---|---|---|
| 7 | C | T2 | 0 | B2 | 17 | 20 |
| 8 | C | T3 | 0 | B2 | 17 | 20 |
| 9 | C | T4 | 0 | B2 | 17 | 20 |
| 10 | C | T5 | 0 | B2 | 17 | 20 |
| 11 | C | T6 | 0 | B2 | 17 | 20 |
| 12 | C | T7 | 0 | B2 | 17 | 20 |
| 13 | F | T1 | −15 | B3 | 22 | 15 |
| 14 | F | T1 | −25 | B3 | 22 | 15 |
| 15 | F | T1 | 15 | B3 | 22 | 15 |
| 16 | F | T1 | 25 | B3 | 22 | 15 |

The evaluation was carried out using a digital copying machine basically having the image forming processes described in FIG. 1, processes of corona charging, laser exposing, reversal developing and statically transferring, a separating claw and a cleaning blade. The combinations of the photoreceptor, the developer and the material and touching condition of the cleaning blade of the copying machine were set as shown in Table 3. Before the test, a setting powder, poly(vinylidene fluoride) powder, was sprayed on the photoreceptor and the cleaning blade and the photoreceptor was rotated for one minute to acclimate them with together.

The copying were performed continuously 200,000 times under conditions of a high temperature of 30° and a high humid of 80% RH which were thought as the most serious conditions. The maximum density, fogging, sharpness and density unevenness of thus obtained copied image were evaluated according to the following norms.

An original image which was equally divided to four area on which a character image having a image area ratio of 7%, a portrait image, a solid white image and a solid black image were respectively arranged was copied to A4 size neutral paper. The copied images of the halftone image, solid white image, solid black image and fine line image were evaluated every 10,000 copies. The maximum density, fogging and the unevenness of the density were determined by absolute reflective density measured by a densitometer RD-91 manufactured by Macbeth Co., Ltd. The fine line was evaluated according to the visibly distinguishable line number per millimeter of the fifth generation copy. For evaluating the cleaning ability, an A3 size original having a solid black image and a solid white image in a ratio of 4:1 was continuously copied for 10 times and the occurrence of incomplete cleaning was decided at the solid white area of the copies. The turning-off of the blade was evaluated according to the number of times of occurrence of the blade turning-off counted during the 200,000 times of copying.

Maximum Density (Solid Black Image Density)

A: Not less than 1.2

B: Not less than 1.0 and less than 1.2

C: Less than 1.0

Fog (Density at White Area)

A: Less than 0.005

B: Not less than 0.005 and less than 0.01

C: Not less than 0.01

Sharpness (Reproduction of Fine Line)

A: Not less than 8 lines/mm

B: Not less than 5.6 and less than 7.1 lines/mm

C: Less than 5 lines/mm

Uneven Density (Density Difference in Half Tone Image)

A: Less than 0.05

B: Not less than 0.05 and less than 0.1

C: Not less than 0.1

Cleaning Characteristics (Removed Toner at White Area of Image)

A: removed development toner was not observed up to 200,000 copies

B: removed development toner was not observed up to 100,000 copies

C: removed development toner was observed less than 100,000 copies

Blade Curling

A: blade curling was not observed up to 200,000 copies

B: slight partial blade curling was observed

C: blade curling was observed

Other Conditions for Evaluation

Further, other evaluation conditions of the digital copying machine were set described below.

Charging Conditions

Charging unit: Scorotron charging unit, in which the initial electrostatic potential was set at −750 V.

Exposure Conditions

Exposure amount was set so that electric potential at the exposed part was −50 V Development Conditions DC bias: −550 V The results are shown in Table 4.

TABLE 4

| Test No. | Maximum Density | Fog | Sharp-ness | Uneven Density | Cleaning Characteristics | Blade Curling |
|---|---|---|---|---|---|---|
| 1 | B | D | D | D | D | D |
| 2 | A | B | A | B | B | A |
| 3 | B | A | A | B | B | A |
| 4 | A | A | A | A | B | A |
| 5 | B | D | D | D | D | D |
| 6 | A | A | A | A | A | A |
| 7 | B | B | B | B | A | A |

TABLE 4-continued

| Test No. | Maximum Density | Fog | Sharp-ness | Uneven Density | Cleaning Characteristics | Blade Curling |
|---|---|---|---|---|---|---|
| 8 | B | B | A | B | A | A |
| 9 | B | B | B | B | A | A |
| 10 | B | B | B | B | A | A |
| 11 | B | B | B | B | A | A |
| 12 | D | D | D | D | B | C |
| 13 | A | A | A | A | A | A |
| 14 | A | A | A | A | A | A |
| 15 | A | A | A | A | B | A |
| 16 | A | A | A | A | B | A |

Samples according to the invention demonstrate superiority in image characteristics such as image density, sharpness and image evenness and cleaning characteristics such as toner removing and blade curling.

What is claimed is:

1. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and a number ratio of toner particles having a shape coefficient of 1.2 to 1.6 is at least 65 percent in the toner particles.

2. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and number ratio of toner particles having no corners is 50 percent or more with reference to whole toner particles.

3. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

4. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner has a number variation coefficient of the number distribution of the toner particle of not more than 27%.

5. A method of forming a toner image of claim 4, wherein the toner has a number variation coefficient of the number distribution of the toner particle of not more than 25%.

6. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner has a number variation coefficient of the shape coefficient of the toner particle of not more than 16%.

7. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner contains toner particles having a shape coefficient of from 1.2 to 1.6 in a ratio of not less than 65% in number and a variation coefficient of the shape coefficient of not more than 16%.

8. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner contains toner particles having a variation coefficient of the shape coefficient of not more than 16% and a variation coefficient of the particle number in the particle size distribution of not more than 27%.

9. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the toner particles are prepared by association of particles obtained by polymerization of monomers in a water based medium.

10. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and contacting width of the cleaning blade is wider than width of the photosensitive layer of the organic photoreceptor.

11. A method of forming a toner image, comprising:

electrically charging a photoreceptor comprising an organic photosensitive layer provided on a cylindrical substrate;

imagewise exposing the photoreceptor so that a latent image is formed on the photoreceptor;

developing the latent image with toner so that a toner image is formed on the photoreceptor;

transferring the toner image to a recording material from the photoreceptor; and cleaning residual toner on the photoreceptor by cleaning blade; wherein the photoreceptor is installed so that the center axis of the cylinder is to be almost horizontal, front edge of the cleaning blade is pressed against surface of the photoreceptor so that cylindrical center angle β of the cylindrical photoreceptor is at an angle of within ±30° with respect to 0° of the vertical line passing the center axis of the cylindrical photoreceptor, ratio of width of the photosensitive layer of the photoreceptor to length of the cylindrical electroconductive substrate is 80/100 to 99/100, and the photoreceptor comprises a protective layer containing a compound containing a fluorine or silicone atom.

* * * * *